US007779556B2

(12) United States Patent
Hill

(10) Patent No.: US 7,779,556 B2
(45) Date of Patent: Aug. 24, 2010

(54) DRYING APPARATUS AND METHOD OF USING THE SAME

(75) Inventor: Randal W. Hill, Baird, TX (US)

(73) Assignee: APT Advanced Trailer and Equipment, LP, Abilene, TX (US)

( * ) Notice: Subject to any disclaimer, the term of this patent is extended or adjusted under 35 U.S.C. 154(b) by 0 days.

(21) Appl. No.: 12/378,194

(22) Filed: Feb. 12, 2009

(65) Prior Publication Data

US 2009/0209192 A1 Aug. 20, 2009

Related U.S. Application Data

(63) Continuation of application No. 10/989,739, filed on Nov. 15, 2004.

(60) Provisional application No. 60/520,415, filed on Nov. 14, 2003.

(51) Int. Cl.
*F26B 19/00* (2006.01)

(52) U.S. Cl. ..... 34/201; 34/443; 34/509; 34/235; 280/763.1; 280/765.1

(58) Field of Classification Search ..... 34/201, 34/443, 507, 509, 511, 235; 16/268; 280/763.1, 280/765.1
See application file for complete search history.

(56) References Cited

U.S. PATENT DOCUMENTS 1,915,424 A * 6/1933 Kerr ..... 52/691
2,649,054 A * 8/1953 Rueckert ..... 105/370
2,714,258 A * 8/1955 Smith et al. ..... 34/214
2,886,105 A * 5/1959 Lee ..... 160/328
3,279,094 A * 10/1966 Blanton, Jr. ..... 34/233
3,281,177 A * 10/1966 Tenenbaum ..... 292/241

(Continued)

FOREIGN PATENT DOCUMENTS

EP 0 348 238 A1 * 12/1989

(Continued)

OTHER PUBLICATIONS

Butts, C.L., et al., "Curing Peanuts Using Continuous Flow Dryers," article dated 2003, 16 pgs., American Society of Agricultural Engineers.

(Continued)

*Primary Examiner*—Kenneth B Rinehart
*Assistant Examiner*—Corey Hall
(74) *Attorney, Agent, or Firm*—Gardere Wynne Sewell LLP

(57) ABSTRACT

Exemplary mobile drying containers and related methods are provided. In one embodiment, the mobile drying container includes a first side wall, a second side wall, a first end wall, a second end wall having a gate, an interior bottom, an upper volume and a lower volume separated by a ventilated floor supported by support members, wheels positioned below the lower volume, and one or more support legs positioned below the lower volume to provide support between the mobile drying container and the ground. The upper volume holds the crop to be dried, and the gate of the second end wall is operable to open and provide a path to dump or remove the crop. The lower volume is operable to receive a flow of air from an opening to assist with the drying of the crop. The present invention also encompasses other embodiments and methods.

4 Claims, 20 Drawing Sheets

U.S. PATENT DOCUMENTS

| | | | | | |
|---|---|---|---|---|---|
| 3,359,650 | A | * | 12/1967 | Mitchell et al. | 34/214 |
| 3,417,487 | A | * | 12/1968 | Harris | 34/233 |
| 3,626,601 | A | | 12/1971 | Moore | |
| 3,664,539 | A | * | 5/1972 | Shahani | 220/323 |
| 3,935,648 | A | | 2/1976 | Cox | |
| 3,972,674 | A | | 8/1976 | Harrell | |
| 4,108,472 | A | * | 8/1978 | Weir | 280/763.1 |
| 4,109,395 | A | | 8/1978 | Huang | |
| 4,123,221 | A | | 10/1978 | Danford | |
| 4,166,505 | A | | 9/1979 | West | |
| 4,222,317 | A | | 9/1980 | Curtis et al. | |
| 4,238,890 | A | | 12/1980 | Curtis et al. | |
| 4,564,368 | A | * | 1/1986 | Sawyer et al. | 44/606 |
| 4,604,815 | A | | 8/1986 | Ridgway | |
| 4,704,807 | A | | 11/1987 | Ridgway | |
| 5,050,923 | A | * | 9/1991 | Petelka | 296/98 |
| 5,160,034 | A | * | 11/1992 | Potter | 209/38 |
| 5,653,043 | A | | 8/1997 | Bestwick et al. | |
| 5,675,910 | A | | 10/1997 | Norris et al. | |
| 5,735,062 | A | | 4/1998 | Sukup | |
| 6,402,451 | B1 | | 6/2002 | Brown | |

FOREIGN PATENT DOCUMENTS

FR 2 670 367 A1 * 6/1992

OTHER PUBLICATIONS

Butts, C.L., et al., "Good Agricultural Practices for Buying Point Operations," article dated Jun. 19, 2002, 11 pgs., American Peanut Council Good Management Practices.

Expert Systems Developed at the NPRL, located at internet website: http://nprl.usda.gov/SoftwareHomePage.htm; 4 pgs., dated Jun. 5, 2003.

U.S. Appl. No. 10/989,739, entitled "Drying Apparatus and Method of Using the Same," filed Nov. 15, 2004.

Advisory Action for U.S. Appl. No. 10/989,739, mailed Dec. 15, 2008.

Notification of Non-Compliant Appeal Brief for U.S. Appl. No. 10/989,739, mailed Nov. 12, 2008.

Examiner's Answer for U.S. Appl. No. 10/989,739, mailed Feb. 26, 2008.

Notification of Non-Compliant Appeal Brief for U.S. Appl. No. 10/989,739, mailed Nov. 21, 2007.

Notification of Non-Compliant Appeal Brief for U.S. Appl. No. 10/989,739, mailed Aug. 29, 2007.

Office Action for U.S. Appl. No. 10/989,739, mailed Apr. 3, 2007.

Interview Summary for U.S. Appl. No. 10/989,739, mailed Feb. 6, 2007.

Office Action for U.S. Appl. No. 10/989,739, mailed Sep. 8, 2006.

Advisory Action Before the Filing of an Appeal Brief for U.S. Appl. No. 10/989,739, mailed Jun. 30, 2006.

Office Action for U.S. Appl. No. 10/989,739, mailed Apr. 12, 2006.

Office Action for U.S. Appl. No. 10/989,739, mailed Oct. 28, 2005.

* cited by examiner

DRYING APPARATUS AND METHOD OF USING THE SAME

CROSS-REFERENCE TO RELATED APPLICATIONS

Pursuant to 35 U.S.C. §120, this continuation application claims priority from, and hereby incorporates by reference for all purposes, copending U.S. patent application Ser. No. 10/989,739, entitled Drying Apparatus and Method of Using the Same, naming Randal W. Hill as inventor, filed Nov. 15, 2004, which, pursuant to 35 U.S.C. §119(e), claims the benefit of U.S. Provisional Patent Application Ser. No. 60/520,415, entitled Drying Apparatus and Method of Using the Same, filed Nov. 14, 2003, naming Randal W. Hill as inventor, which is hereby incorporated by reference for all purposes.

TECHNICAL FIELD OF THE INVENTION

This invention relates in general to the field of drying containers and more specifically to the field of mobile drying containers used to dry crops, such as, for example, a peanut trailer used to store and dry large quantities of peanuts.

BACKGROUND OF THE INVENTION

As harvesting technologies advance, the harvesting capacity of field crops increase. However, in many types of field crops the moisture content must be removed through a drying process—typically referred to as "curing." Such a curing process is seen by many as a bottleneck in the overall production process of a crop. Therefore, it is desirable to batch process the crop. For example, a typical practice in peanut processing is to load harvested peanuts into a wagon and transport the peanuts to a central location. At the central location, the peanuts are offloaded into large commercial curing facilities and dried to a suitable moisture content—typically less than 10%. While such a practice enables batch processing, inefficiencies are perceived. The peanuts must be transferred multiple times. For example, peanuts are first loaded into the wagon; then the peanuts are transferred into the curing facility; and then the peanuts are transferred to another container to load into a storage facility. Additionally, the peanuts can only be processed at the remote facility—sometimes requiring undesirable travel distances.

In yet other practices of the peanut processing, the inefficiencies of a crop transfer are reduced by utilization of specially-designed peanut wagons in the field. The peanut wagons have perforated floors. After deposit of the harvested peanuts, the peanut wagons are placed under a cover and warm air is injected through the perforated floors. The consequence of such a practice is the inability to batch process the peanuts. And, as the size of the peanut wagon increases, concern is given to the structural limitations that may exist—e.g., from the increased loading of the wagon. Additionally, an increased size peanut wagon may not be economically feasible or capable of traveling distances to the storage facility. Further concerns include regulations that make it necessary to cure peanuts in batches to maintain the identity of the peanuts until they are sold.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which.

DETAILED DESCRIPTION OF THE INVENTION

It should be understood at the outset that although an exemplary implementation of the present invention is illustrated below, the present invention may be implemented using any number of techniques, whether currently known or in existence. The present invention should in no way be limited to the exemplary implementations, drawings, and techniques illustrated below, including the exemplary design and implementation illustrated and described herein.

One aspect of the invention generally involves the conversion of any container, van, or trailer (hereinafter referred to as "storage container 50") into a drying container 100. In this aspect of the invention, a crop, such as peanuts, can be deposited through an opening 124 (FIG. 3) into a bin 200 (FIG. 3) within the drying container 100. The crop, upon being inserted into the drying container 100, rests upon a floor 150

Figure 4:
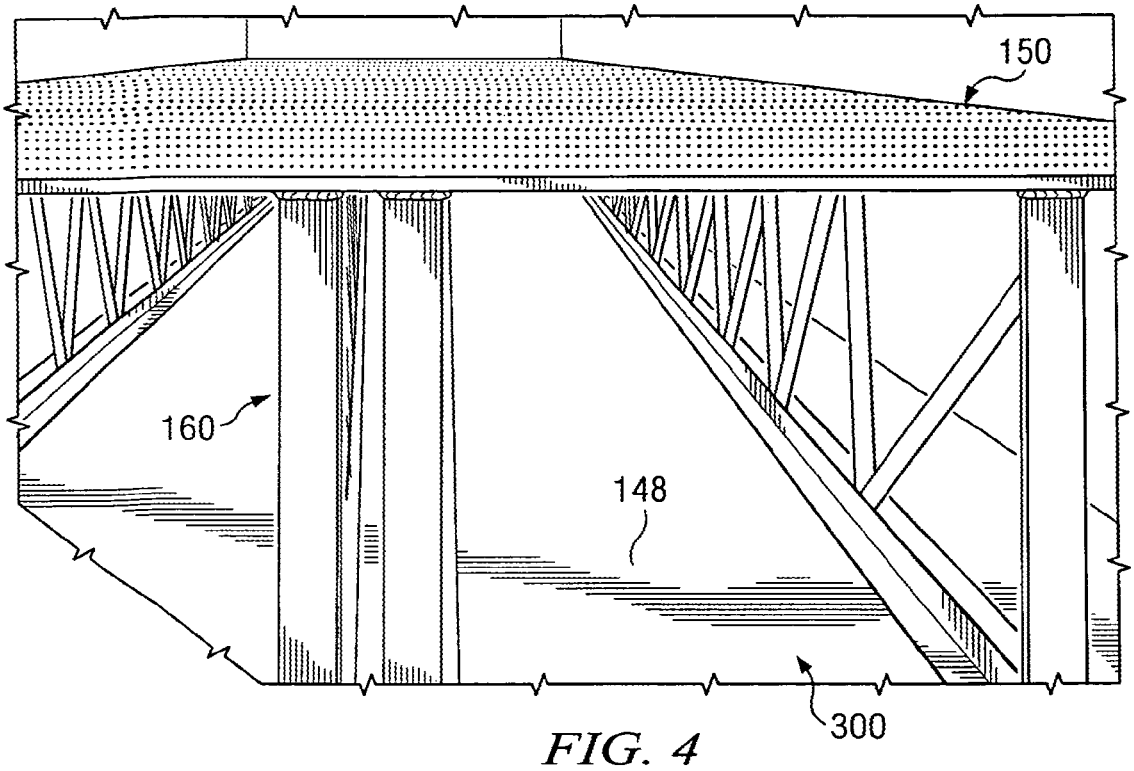
FIGS. 4, 5, 6A, AND 6B show a view of a support system, which can be used to support the floor, according to an aspect of the invention.
Figure 5:
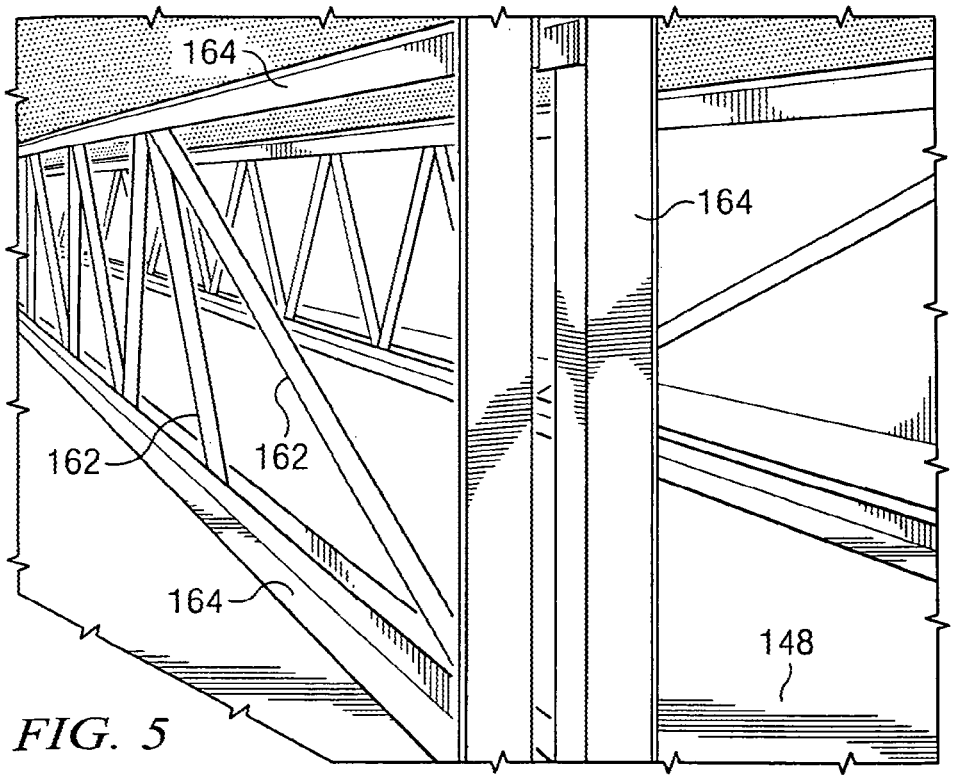

(FIG. 3), which is made of a screen 152 (FIG. 8), having a plurality of holes therein. The holes are preferably small enough to prevent the crop from passing therethrough. The floor 150 (FIG. 3) is elevated above an interior bottom 148 (FIG. 3) of the drying container 100 to create a plenum 300 (FIG. 3), which may be referred to as a lower volume 300. The elevation of the floor 150 (FIG. 3) above the interior bottom 148 (FIG. 3) is facilitated via a support system 160 (FIGS. 4-6). The plenum 300 (FIG. 3) is in communication with at least one plenum opening 310 (FIGS. 2A, 12, and 16), which couples with a blower to pressurize the plenum 300 (FIG. 3) with warm air flow. The pressurization of the plenum 300 with warm air flow forces air up into the bin 200 (FIG. 3), which may be referred to as an upper volume, through the screen 152 to facilitate a drying of the crop.

After drying of the crop, the drying container 100 can be unloaded in a variety of manners. For example, the entire drying container 100 can be hydraulically lifted to a vertical position, doors 105 (FIG. 2B) can be opened, and the contents of the bin 200 can be dumped out. While these general aspects of the invention have been described above, other aspects of the invention will become apparent with reference to the description below and figures, corresponding thereto.

Another aspect of the invention generally includes utilization of a drying container 100, having wheels 500, which allows movement of the drying container 100—e.g., in a crop field or on the road towards a storage facility.

Figure 1:
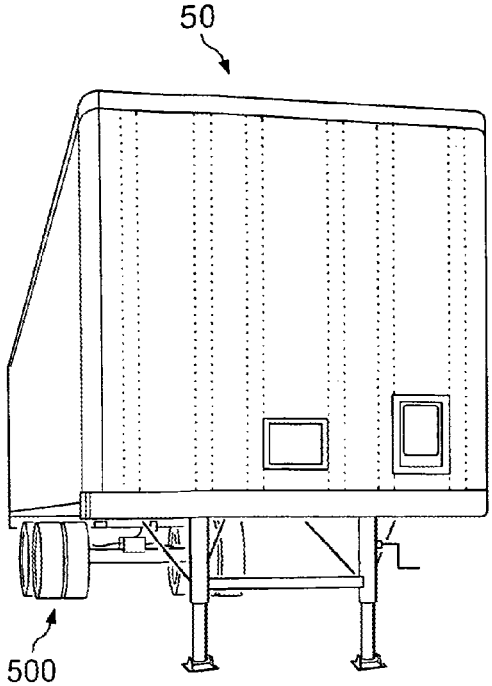
FIG. 1 shows a perspective view of a storage container.
Figure 2A:
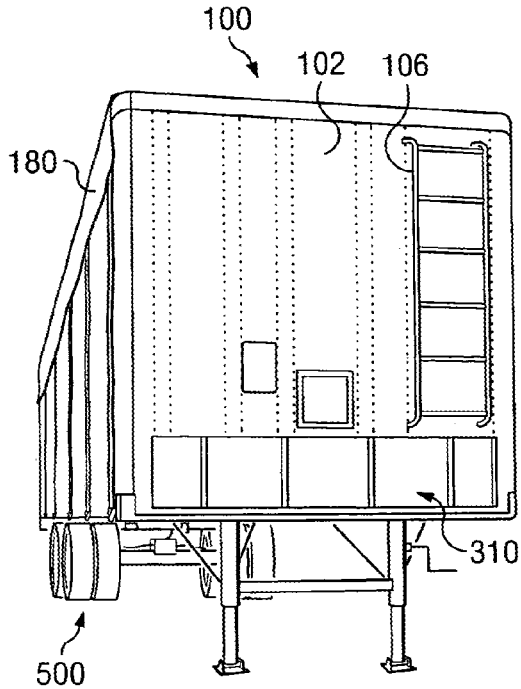
FIGS. 2A AND 2B show perspective view of a drying container, according to an aspect of the invention.
Figure 2B:
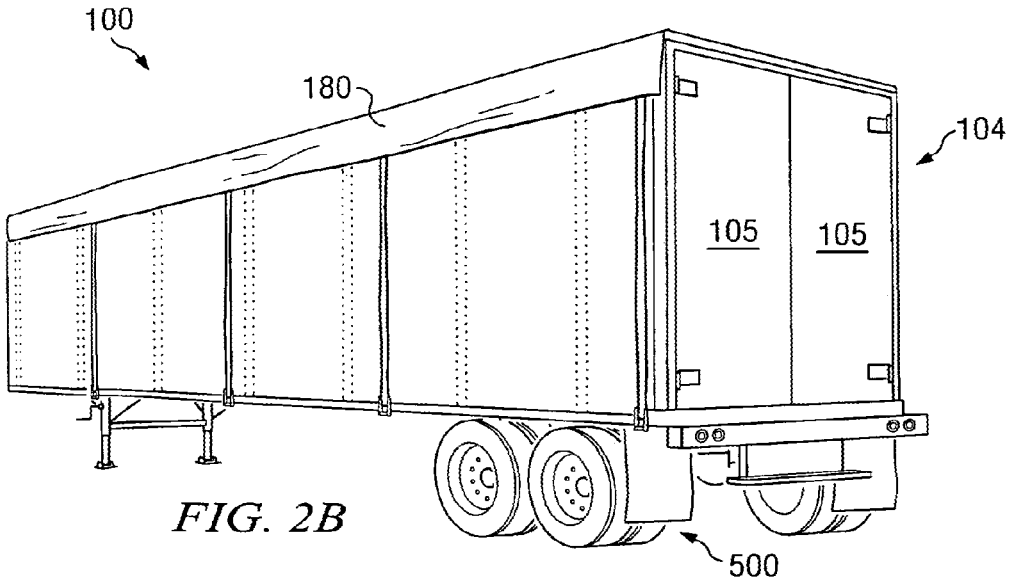

FIGS. 1, 2A, and 2B show a general "before and after" view of a storage container 50/drying container 100, according to an aspect of the invention. FIG. 1 is a view of a storage container 50 (the before) while FIGS. 2A and 2B are a view of a drying container 100 (the after). As referenced above, the storage container 50 can be any commercially-available storage container including, but not limited to, rail vans, cargo boxes, trailers, and the like. The general description of the storage containers 50, described herein, is intended as being only illustrative of some of the many storage containers 50 that can be converted into a drying container 100. Other storage containers 50 should become apparent to one of ordinary skill in the art. Additionally, while a general description of a conversion of a storage container is given herein it should be expressly understood that in other aspects of the invention the drying container 100 can be made directly rather than being converted from a storage container 50.

With reference to FIGS. 2A and 2B, the conversion of the storage container 50 into the drying container 100 includes incorporation of several features, namely a plenum opening 310 and a ladder 106 at a front end 102, which may also be referred to as a front wall, of the drying container 100 and a tarp 180 on the top of the drying container 100. Such features, along with other features described below, allow the drying container 100 to facilitate the drying of crops—e.g., peanuts.

FIG. 2B generally shows a back end 104 of the drying container 100, which may also be referred to as a back wall. The back end 104 can include standard component parts generally available in a storage container 50—e.g., doors 105.

While the plenum opening 310 is generally shown on a front end 102 of the drying container 100 in the aspect of FIG. 2A, it should be expressly understood that the plenum opening 310 can be positioned in other locations as will be described below with reference to FIG. 16.

In the general design of the drying container 100, care must be taken to ensure that the drying container 100 can withstand the loads that will be placed thereon. Therefore, for example, in aspects of the invention involving a conversion of a storage container 50 into a drying container 100, consideration can be given to certain structural features of the storage container 50, which have been designed to support a load. In several aspects of the invention, structural features of the storage container 50 can be utilized in support of the load being placed on the drying container 100. More details of this aspect of the invention will be described below.

Figure 3:
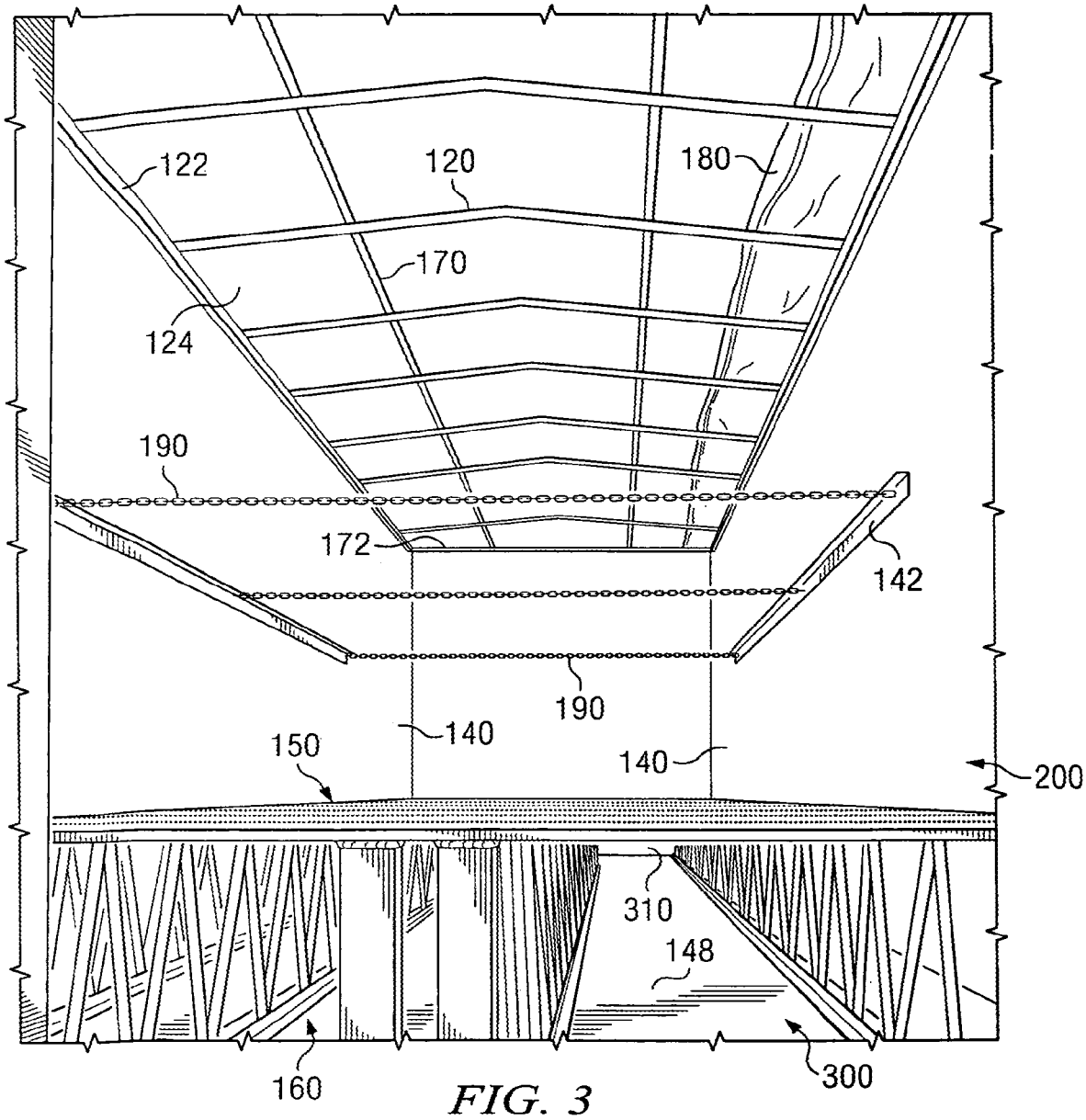
FIG. 3 shows a perspective view of an interior of a drying container, according to an aspect of the invention.

FIG. 3 shows a perspective view of an interior of the drying container 100, according to an aspect of the invention. This view is taken from a back end 104 of the drying container with doors 105 opened. The plenum opening 310 is partially seen on an opposite end of the drying container 100. In this aspect of the invention, the drying container 100 generally includes an interior side wall 140 (which may include a first side wall and a second side wall, an interior bottom 148, cross members 120, ridge straps 170, a floor 150, and a support system 160. While such features will generally be described below, it is to be expressly understood that in other aspects of the invention, other component parts may be utilized and the component parts described herein may additionally be modified. The ultimate design of the drying container 100 will, to a certain degree, depend on the dynamics of the particular use in which the drying container 100 will be used.

The interior sidewalls 140 and interior bottom 148 help define the interior space of the drying container 100. The insertion of a floor 150 above the interior bottom 148 divides the interior space of the drying container 100 into a bin 200 and a plenum 300. Generally, a crop, such as peanuts, can be placed inside the bin 200—the bin 200 being elevated above the interior bottom 148. Warm air or the like can then be injected into the plenum 300 (area between the interior bottom 148 and floor 150) and allowed to seep up through the floor 150 to dry the crop. The details of the floor 150 will be described in more detail below with reference to FIGS. 4, 6, 6A, and 6B.

The crop can be placed into the storage bin 200 utilizing any techniques, now known or later developed. Such techniques include, but are not limited to, depositions into the bin via an auger or conveyer belt. To facilitate the deposition of a crop, such as peanuts, into the bin 200, this aspect of the drying container 100 includes an opening 124. In aspects of the invention involving the conversion of a storage container 50 that has a roof (e.g., if the storage container 50 is a rail van), the roof can be cut off or stripped from the storage container 50.

Roof bows or cross members 120 can serve to provide structural integrity similar to that provided by a roof—e.g., a brace for the interior sidewalls 140. The cross member 120 can be mounted to top rails 122 atop the interior sidewalls 140 of the drying container 100. Such cross members 120 can be made of virtually any material suitable for their intended purposes including, but not limited to, tube steel.

A tarp 180 can be incorporated adjacent the cross members 120 to allow selective covering of the opening 124 of the drying container 100 to prevent environmental elements, such as rain, from entering the interior of the drying container 100. The use of a tarp 180—e.g., that is rolled over the cross members 120—should become apparent to one of ordinary skill in the art. The cross members 120 in this aspect of the invention have a peaked center portion, which allows the environmental elements to roll off the tarp 180. To prevent environmental elements, such as water, from standing in areas upon the tarp 180 between the cross members 120, ridge straps 170 can be used. In this aspect of the invention, two independent ridge straps 170 are positioned on top of the cross members 120 down the length of the drying container 100. The ridge straps 170 elevate the tarp 180 (when placed over the cross members) to decrease the surface area of the tarp 180 between the cross members 120—helping to prevent sinking of the tarp 180 between the cross members 120. The ridge straps 170 can be adjusted (e.g., tightened down onto the cross members 120), utilizing ridge strap wenches 172.

The interior sidewalls 140 in this aspect of the invention include sidewall members 142—one on each interior sidewall 140. The sidewall members 142 can be coupled to posts (not seen), which may extend inside the interior sidewalls 140. Chains 190 are stretched between the sidewall members 142 to provide additional structural support to the interior sidewalls 140. When a large crop load is placed within the bin 200, the chains 190 prevent the sidewall members 142 and sidewalls 140 from extending outwardly.

The deposition of a large crop load in the bin 200 creates a large force on the floor 150. The support system 160 works to support the floor 150, resisting the load while facilitating air flow through the plenum 300. In one aspect of the invention, gates (not shown) can be placed over an end area generally defined by the plenum 300. In this aspect, the gates would not allow any particles that fell into the plenum 300 to escape, e.g., during dumping of the drying container 100 as described above (e.g., hydraulically lifting the drying container 100 into a vertical position and opening the doors 105). Such an aspect can be beneficial in circumstances in which sand, gravel, or the like fell into the plenum 300. The gates that are placed over an end area generally defined by the plenum 300 would not allow the sand, gravel, or the like to escape the drying container 100 during dumping of the contents of the bin 200. After dumping of the bin 200, the sand, gravel, or the like can easily be cleaned out of the plenum 300 by opening the gates that are placed over an end area generally defined by the plenum 300 and the doors 105 and injecting air into the plenum opening 310 (shown in FIG. 2A).

FIGS. 4, 5, 6A, AND 6B show several views of a support system 160 which can be used to support the floor 150, according to an aspect of the invention. As referenced above, the plenum 300 allows the circulation of airflow under the floor 150 to allow seeping through the floor 150. To support the floor 150, the support system 160 in this aspect of the invention includes a series of trussed support members 162 and angle members 164. These may be referred to as "engineered joists" and are designed to support the crop, such as a load of peanuts, above the ventilated floor or screen 152.

Figure 6A:
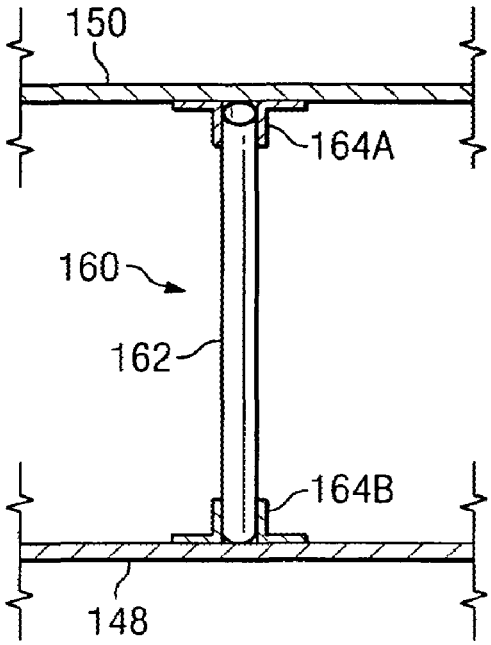

With reference to FIG. 6A, a schematic of an orientation of the support member 162, angle members 164, interior bottom 148, and floor 150 is shown. A pair of lower angle members 164B are in contact with the interior bottom 148 and a pair of upper angle members 164A are in contact with the floor 150 (such as ventilated floor 150). The support member 162 is disposed between each pair of angle members between the floor 150 and the interior bottom 148.

Figure 6B:
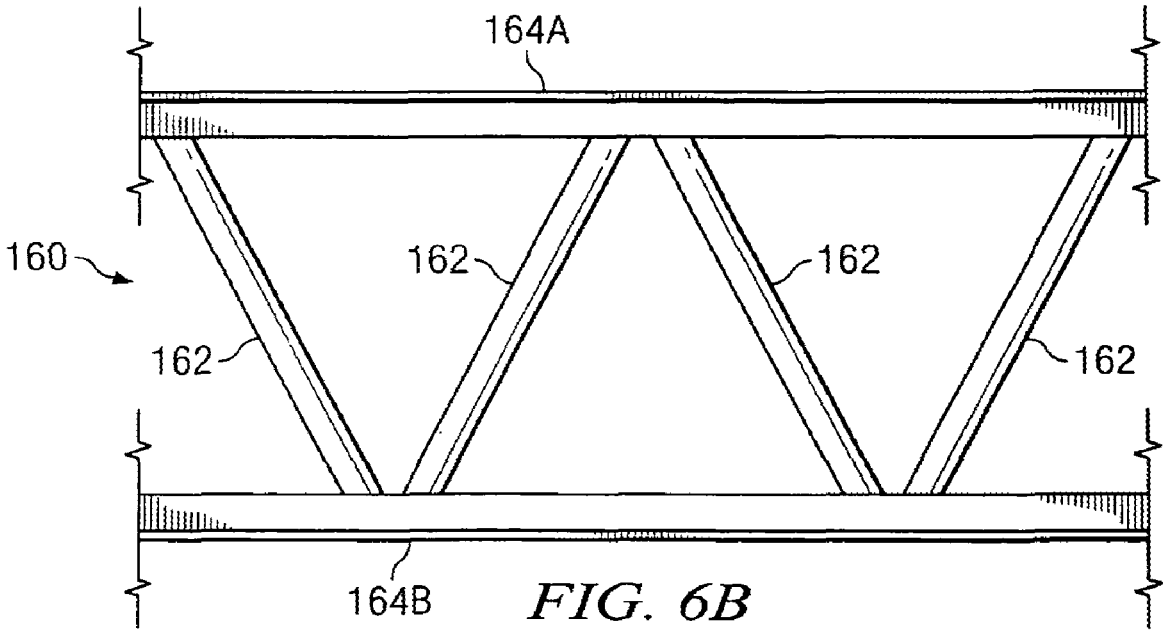

With reference to FIG. 6B, a schematic of a side view of the support system 160 is shown in isolation, according to an aspect of the invention. The support members 162 are shown in a trussed configuration between the upper angle members 164A and lower angle members 164B. Trussing the support members 162 provides structural advantages, which should become apparent to one of ordinary skill in the art—e.g., a structural rigidity. While such a specific trussing configuration is shown in this aspect of the invention, it should be understood that in other aspects of the invention, other trussing configurations can additionally be used.

Figure 12:
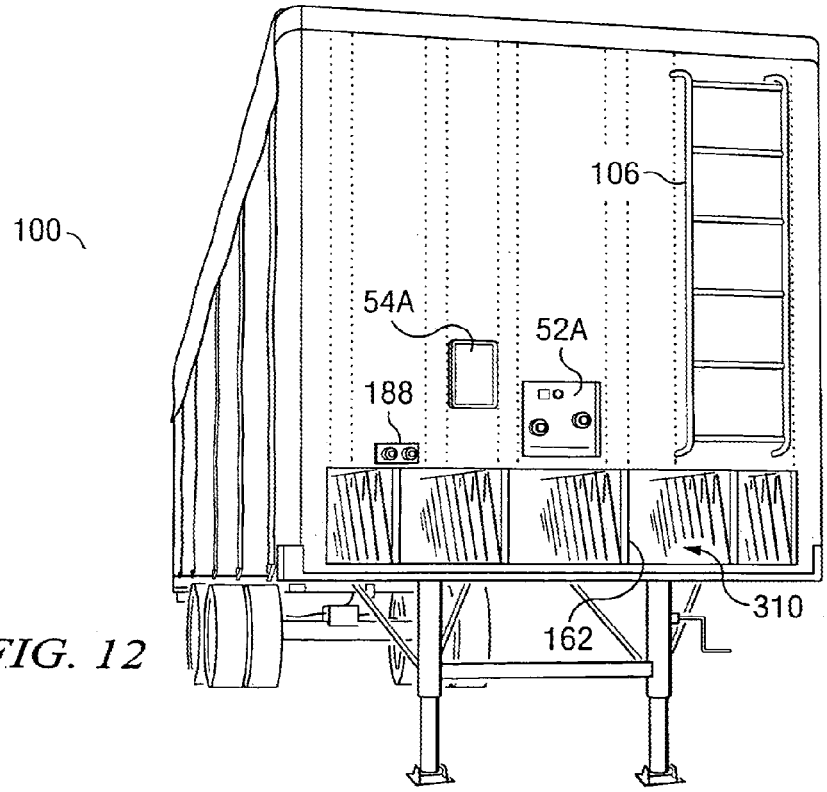
FIG. 12 shows a close-up view of a front of a drying container with a new location for various component parts, according to an aspect of the invention.

With reference to FIGS. 4, 6A and 6B, the trussed support members 162 (along with angle members 164) can generally be seen in rows. With reference to FIG. 12, four rows of trussed support members 162 are shown through the plenum opening 310.

The trussed support members 162 are preferably primed or processed to prevent rust and/or deterioration. Such priming and/or processing can include any technique, now known or later developed. Additionally, in one aspect of the invention, the rows of trussed support members 162 can be coupled to the interior bottom 148 at two locations: near the front end 102 and the back end 104 of the drying container 100, e.g, via welding. Such a coupling prevents the rows of trussed support members 162 from rising up from the interior bottom 148. In other aspects of the invention, the rows of trussed support members 162 can be coupled in other areas.

As the air flows through the plenum 300, the trussed support members 162 will create some disturbance of the air flow. In some aspects of the invention, additional disturbance may be necessary. As such, in those aspects of the invention, baffles (not shown) can be positioned in various locations of the plenum 300.

With the configuration shown in this aspect of the invention (four rows of trussed support members 162), the support system 160 can support 125,000 pounds of pressure—allowing heavy crop loads to be placed upon the floor 150. Such a support loading is intended as only illustrative of a load that can be supported as other loads can be supported in other aspects of the invention—e.g., heavier loads or lighter loads.

Figure 7:
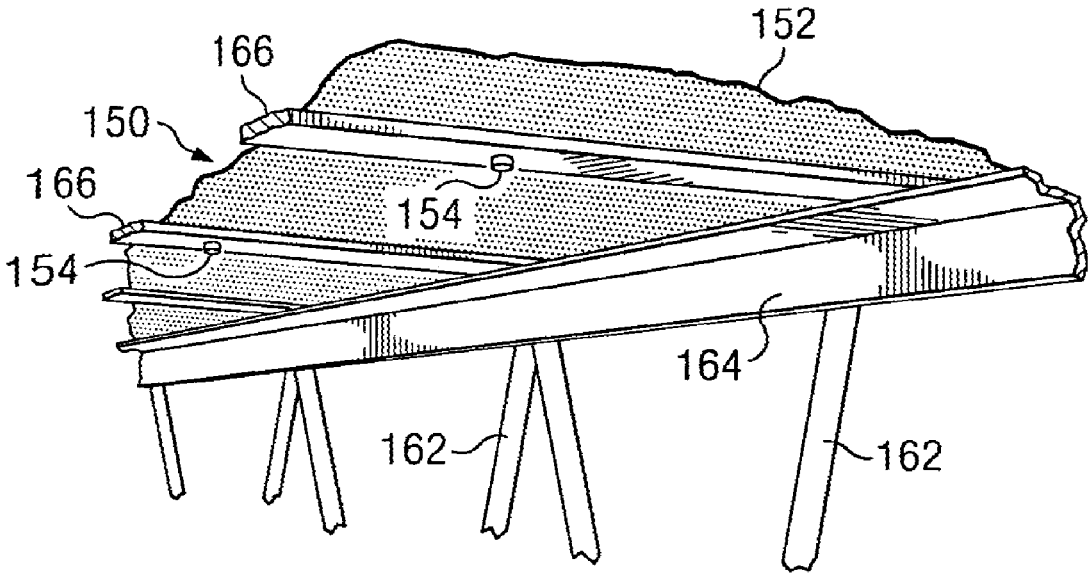
FIG. 7 shows a bottom perspective view of a floor, according to an aspect of the invention.

FIG. 7 shows a bottom perspective view of the floor 150, looking up. The floor 150 in this aspect of the invention is shown as a screen 152, which will be described in more detail below with reference to FIG. 8. The support members 162 are providing support to the upper angle members 164A. The screen 152 could be placed directly on the upper angle members 164A; however, in this aspect of the invention, a flat bar or support piece 166 is mounted on the upper angle members 164A between the rows of trussed support members 162 and angle members 164. The mounting of the support piece 166 to the upper angle members 164A can include a variety of coupling techniques known by one of ordinary skill in the art, including, but not limited to, soldering. The support piece 166 provides additional support to the screen 152 as should be recognized by one of ordinary skill in the art—e.g, a reduced support area that prevents sinking of the screen 152 between the rows of double trussed members and double paired angle members. The screen 152 is coupled to the support piece 166 via coupling members 154, which in this aspect of the invention is shown as rivets. The use of rivets for the coupling members 154 allows an ease of removability of the coupling members 154. For example, rivets can be drilled out and easily replaced if the coupling member 154 or a portion of the screen 152 becomes damaged.

Figure 8:
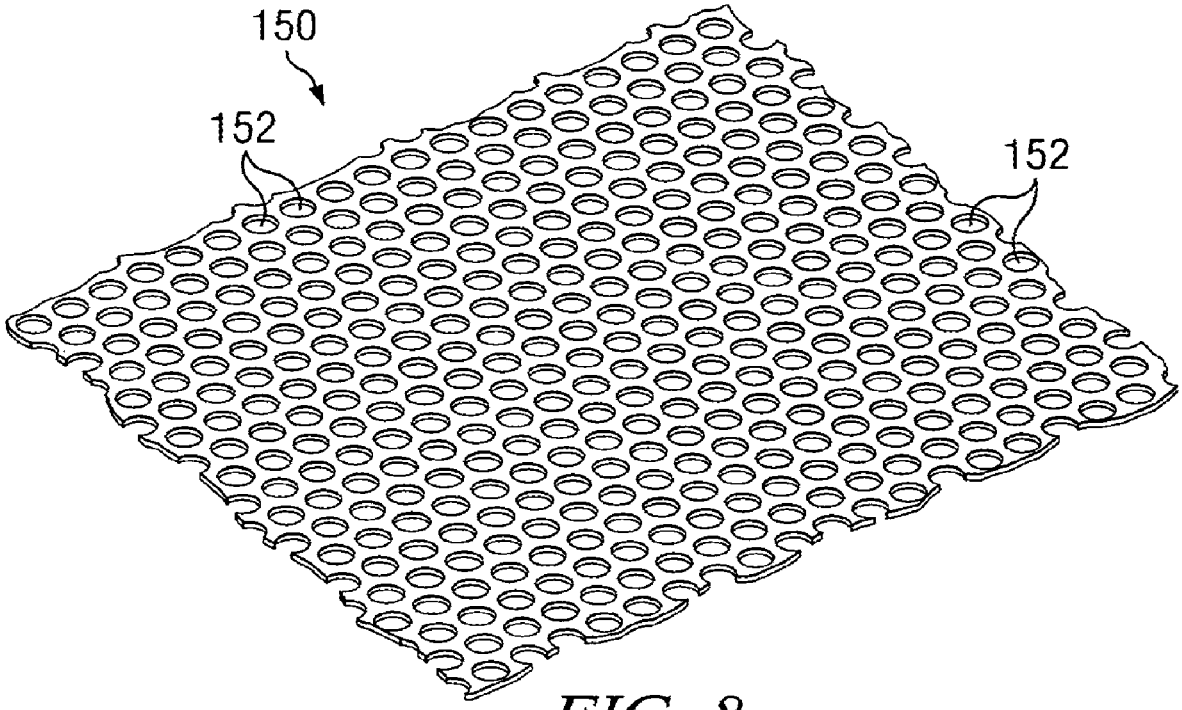
FIG. 8 shows a top perspective view of a floor, according to an aspect of the invention.

FIG. 8 shows a top perspective view of the floor 150 looking down. The floor 150, as referenced above, can be a screen 152. The screen 152 in this aspect of the invention is shown having a plurality of holes disposed therein. Preferably, the screen 152 has a 40% opening; however, other percentages of opening can additionally be used as will become apparent to one of ordinary skill in the art. Additionally, the screen 152 preferably has a fourteen gauge thickness; and the material for the screen 152 is preferably a cold rolled metal that is processed with a brush and a rust prevention oil. Cold rolling is a metal processing technique, which should become apparent to one of ordinary skill in the art. The use of cold rolled metal that has been brushed and processed with rust prevention oil extends the life of the floor 150.

Figure 9:
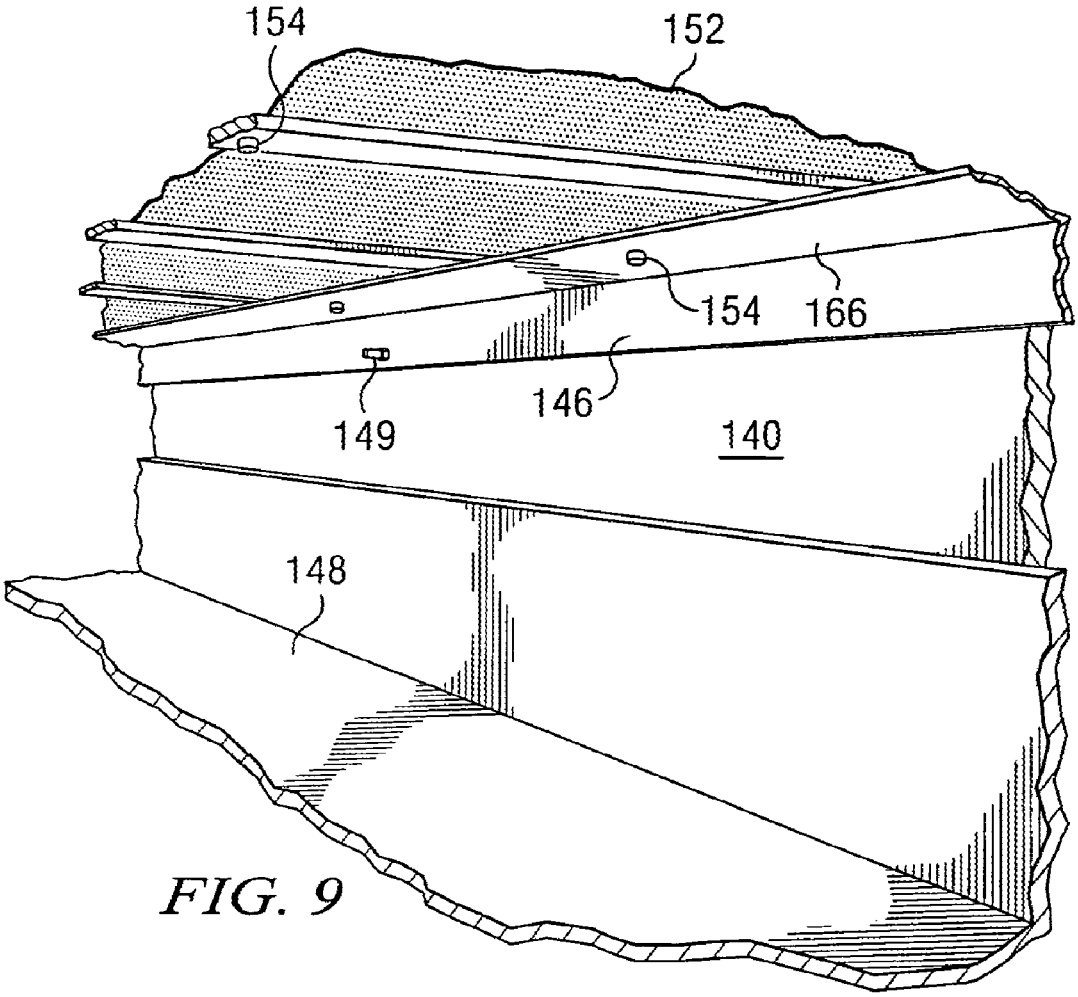
FIG. 9 shows a bottom perspective view of a floor and its coupling to the sidewall, according to an aspect of the invention.

FIG. 9 shows a bottom perspective view of the floor 150 and its coupling to the interior sidewall 140. In addition to the use of support members 162 (described with reference to FIGS. 4-6A and 6B ), the support system 160 can utilize portions of interior sidewall 140. In such an aspect of the invention, the interior sidewall 140 can include posts or side supports (not seen in FIG. 9, but generally referenced in FIG. 13) that are typically available in the interior sidewalls 140 of a storage container 50. A mounting member 146 can be coupled to the posts utilizing a mounting piece 149 (e.g., bolts and screws). In some aspects of the invention (e.g., a conversion of a storage container 50 into a drying container 100), the sidewalls 140 may already have a mounting member 146. In other aspects of the invention, the mounting member 146 may need to be coupled to the post of the interior sidewall 140. In yet other aspects of the invention, the floor 150 may not utilize portions of the interior sidewall 140. The screen 152 is shown coupled to the mounting member 146 via a coupling member 154 in the same manner in which the screen 152 is coupled to the support piece 166 via the coupling member 154.

Figure 10:
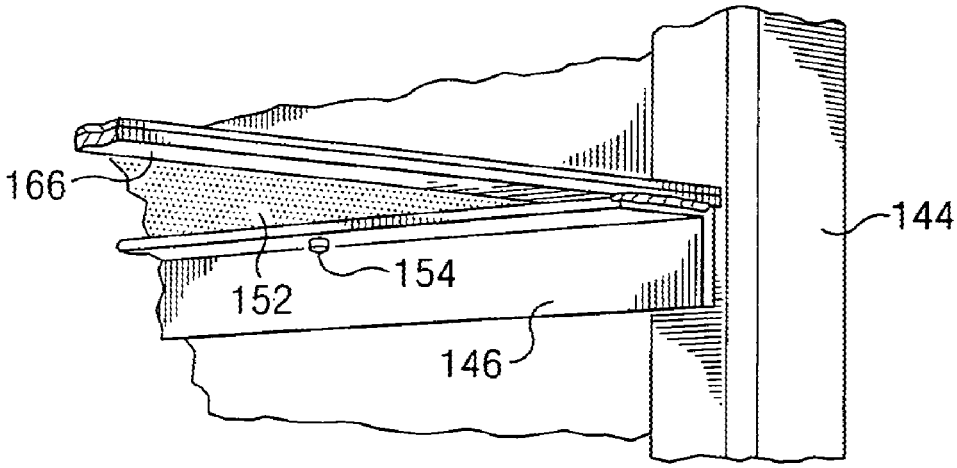
FIG. 10 shows another bottom perspective view of a floor and its coupling to the sidewall, according to an aspect of the invention.

FIG. 10 shows another bottom perspective view of the floor 150 and its coupling to the interior sidewall 140. The mounting member 146 is shown generally secured to the interior sidewall 140. A support piece 166 is mounted on top of the mounting member 146. In this aspect of the invention, the support piece 166 is shown as soldered onto the mounting member 146. The screen 152 is shown positioned on top of the support piece 166 and the screen 152 is shown coupled to the mounting member 146 via the coupling member 154. The mounting member 146 is additionally shown in this aspect of the invention as being coupled to a corner post 144—for example, via soldering.

Figure 11:
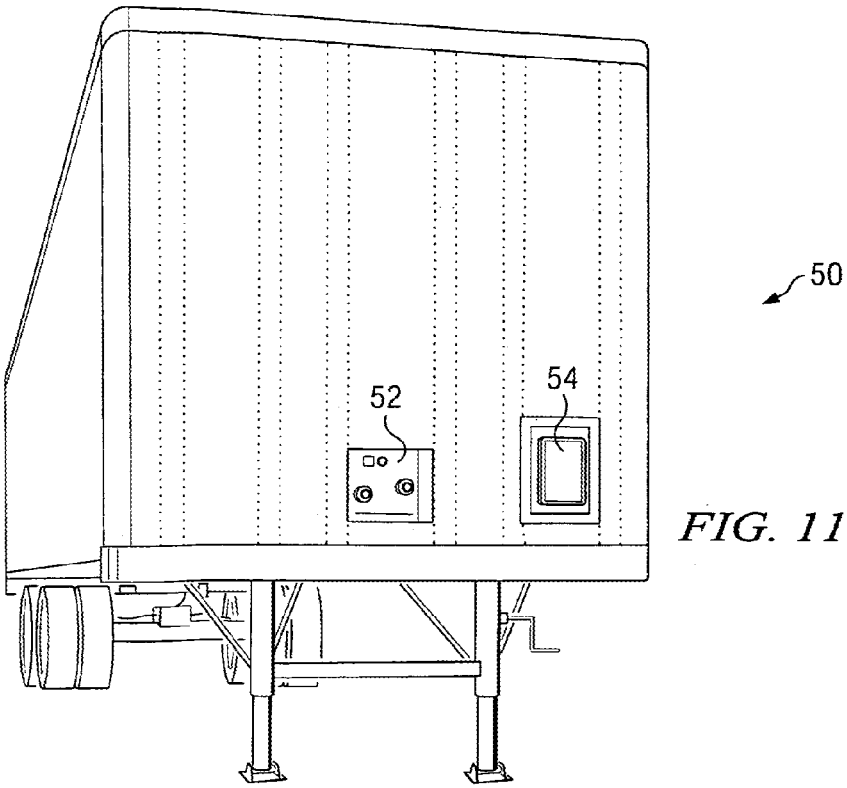
FIG. 11 shows a close up view of a front of a storage container with various component parts.

FIG. 11 shows a close-up view of a front of a standard storage container 50 similar to FIG. 1. In the standard storage container 50, a variety of component parts exist, including items such as hookups 52 (e.g., an air break access point) and document boxes 54.

FIG. 12 shows a close-up view of a front of a drying container 100—e.g., converted from the storage container 50 of FIG. 11—with a new location for various component parts. The hookups 52 of FIG. 11 have been elevated to the location of hookup 52A of FIG. 12. Additionally, the document box 54 in FIG. 11 has been moved to the new location of document box 54A of FIG. 12. The new location of these component parts allows the positioning of a plenum opening 310 in the front of the drying container 100.

The front of the drying container 100 in this aspect of the invention includes blower couplings 188, which facilitate the connection of any blower, now known or later developed. The blower injects air pressure into the plenum opening 310 and into the plenum 300 to seep up through the floor 150 and dry the crop that is placed within the bin 200. Additionally shown is the ladder 106, which allows an individual to view the opening 124 (FIG. 3).

Figure 13:
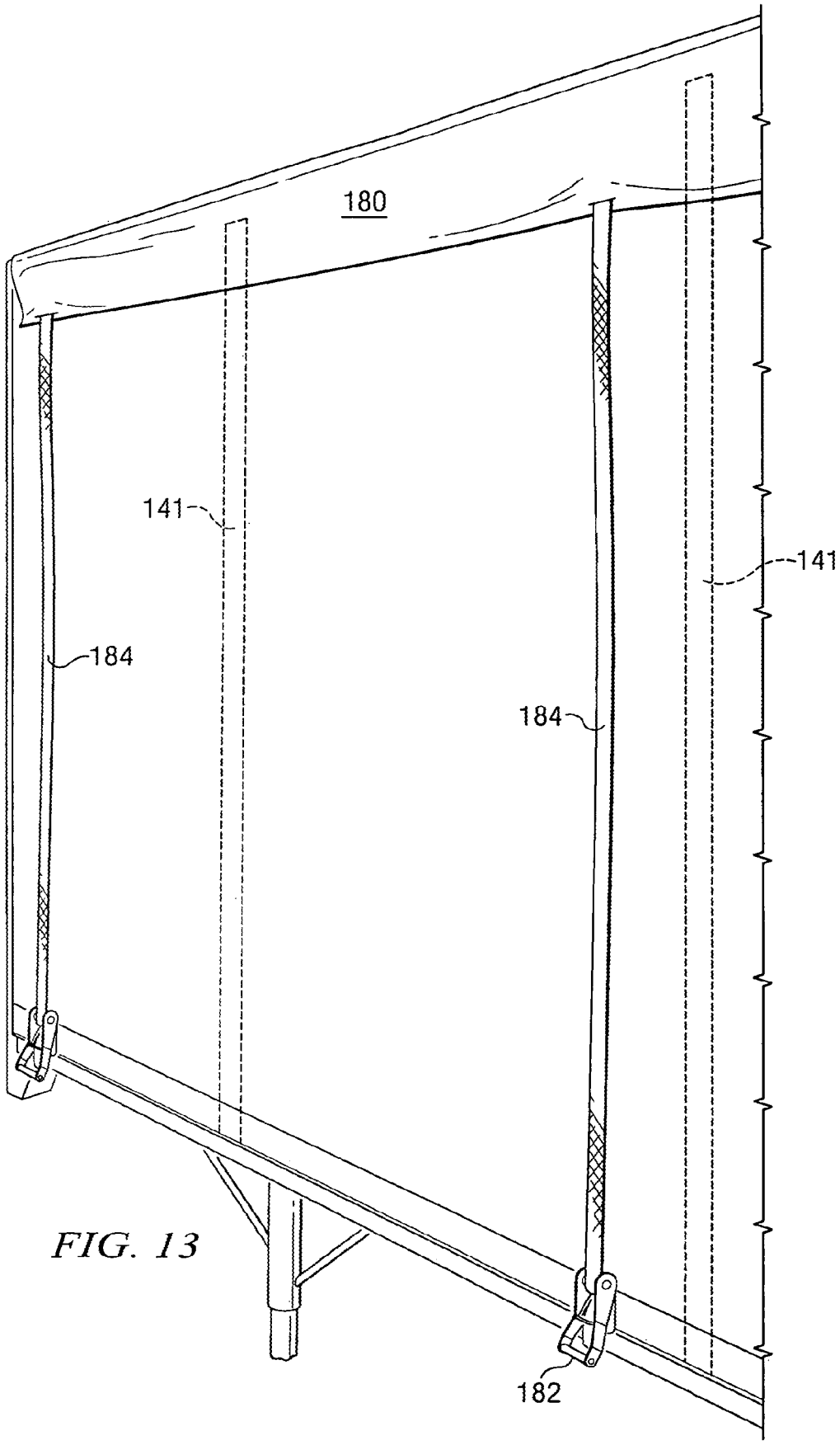
FIG. 13 shows a close-up view of tarp straps, according to an aspect of the invention.
Figure 14:
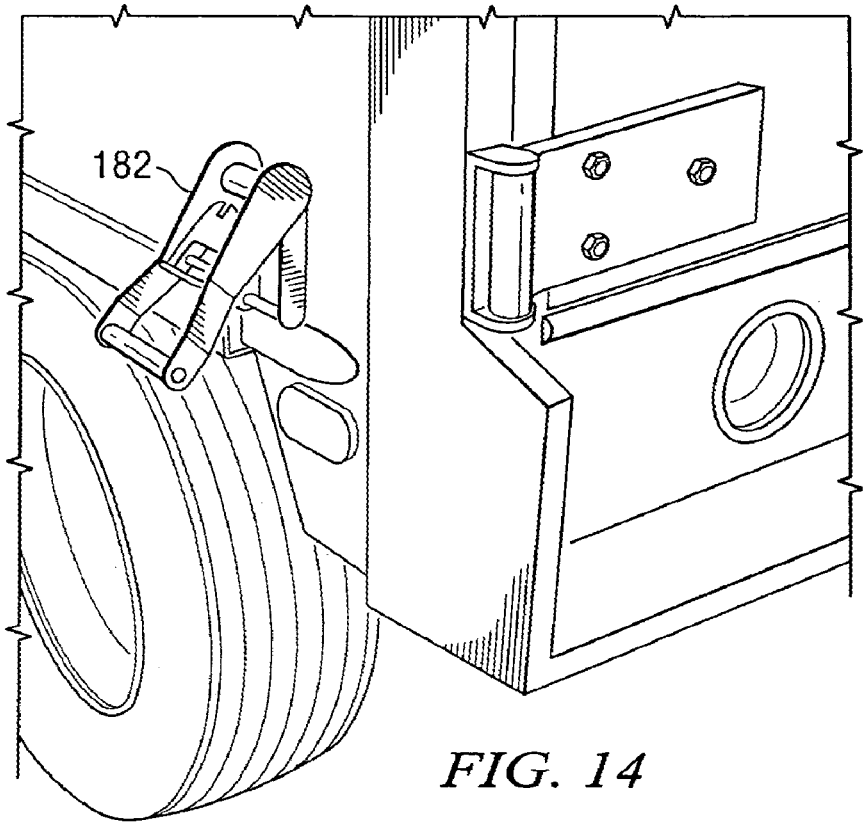
FIG. 14 shows a close-up view of a wench, which can be used with a tarp strap, according to an aspect of the invention.

FIGS. 13 AND 14 show close-up views of component parts that can be utilized to tighten down a tarp 180. FIG. 13 generally shows tarp straps 184. The tarp straps 184, as should be recognized by one of ordinary skill in the art, facilitate the bracing of the tarp 180 to the top of the drying container 100. With reference to FIGS. 13 and 14, wenches 182 can be used to tighten down the tarp straps 184. Additionally shown in FIG. 13 are sidewall support members 141, which correspond to side supports that are within the walls of the drying container 100. As indicated above with reference to FIG. 9, such side supports can be contained within a variety of different storage containers 50 (ultimately transformed into drying containers 100). The sidewall member 142 (FIG. 3) and mounting member 146 (FIG. 9) can be coupled to the side supports of drying containers 100 containing such side supports.

Figure 15:
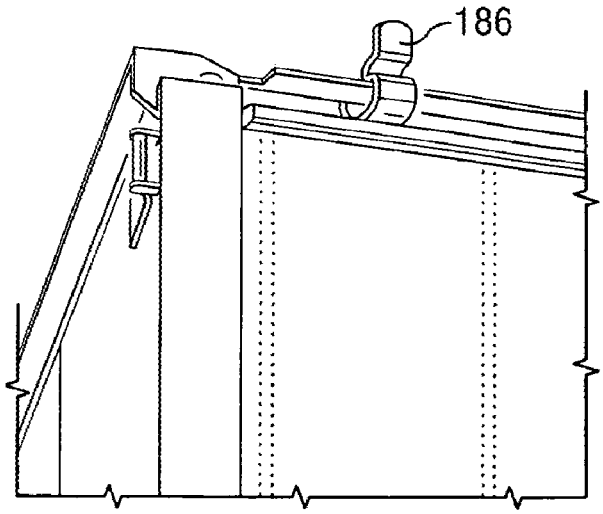
FIG. 15 shows a close-up view of a wench, which can be used with a tarp strap, according to an aspect of the invention.

FIG. 15 shows a close-up view of a tarp stop 186, which can be used with the tarp 180. The particular tarp stop 186 shown in FIG. 15 is an easy off tarp stop 186, which allows for easy removal of the tarp 180 without using any tools, as would be recognized by one of ordinary skill in the art.

Figure 16:
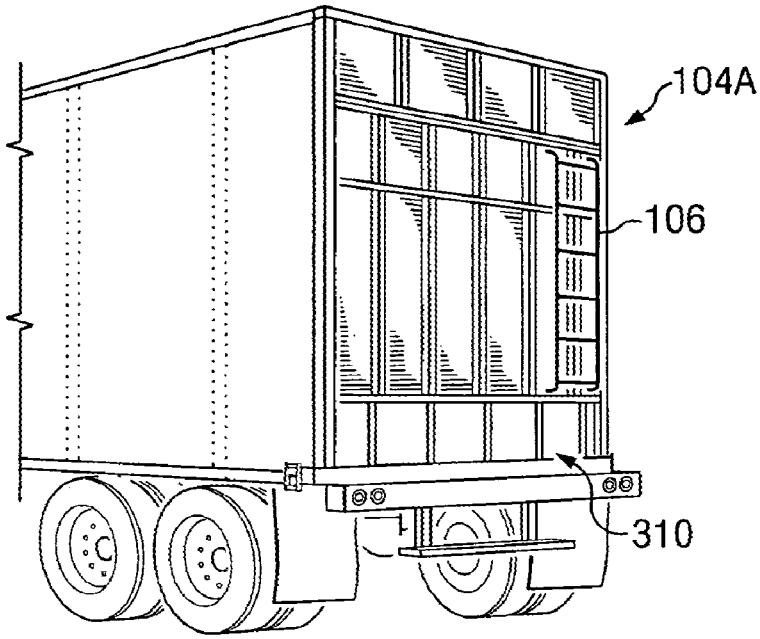
FIG. 16 shows a view of a back of a converted trailer with a rear conversion, according to an aspect of the invention.

FIG. 16 shows a view of a back of a drying container 100 with a conversion at the back end 104A of the drying container 100. The back end 104A can be a custom made end to replace doors 105 (see FIG. 2B) to include the plenum opening 310 at this location in addition to or instead of being located at the front end 102 or elsewhere on the drying container 100. Additionally, the back end 104A can be made to hingeably position to the remaining portion of the drying container 100, for example, to empty the bin 200 in a manner similar to that described above (the entire drying container 100 can be hydraulically lifted to a vertical position, the dump gate can be opened, and the contents of the bin 200 can be dumped out). Such a conversion of the back end 104A illustrates that the plenum opening 310 can be in a variety of locations. For example, in some aspects of the invention, the plenum opening 310 could be positioned on a side of the drying container 100 or underneath the drying container 100. In yet other aspects of the invention, more than one plenum opening 310 can be utilized—e.g, one in the front and one in the back with blowers or other equipment being capable of connecting to both plenum openings 310. In still further aspects of the invention, multiple plenum openings 310 can be provided, but only one plenum opening 310 utilized—e.g., giving an operator a choice of which plenum opening 310 to utilize in particular situations. In such an aspect of the invention, the plenum openings 310 can be outfitted with sealable doors such that the plenum that is not utilized can be sealed to maintain the pressure buildup inside the plenum 300.

Figure 17:
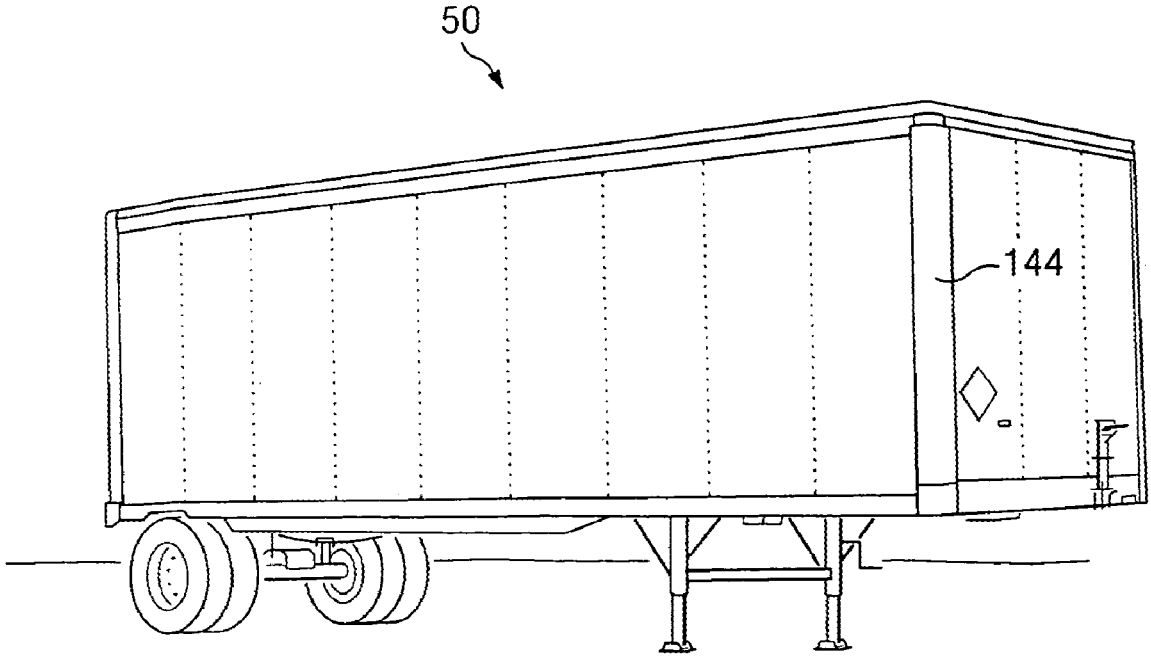
FIG. 17 shows a view of another type of storage container, which can be converted, according to an aspect of the invention.

FIG. 17 shows a view of another type of storage container 50, which can be converted into a drying container 100. The illustration of the storage container 50 in FIG. 17 is intended as expounding upon the concept briefly described above—that any storage container 50 can be utilized. The storage container 50 of FIG. 17 is a 28-foot pup trailer. Such a storage container 50 allows for smaller drying containers 100. As described above, features of storage container 50 can be utilized in facilitating structural support of the drying container 100. In FIG. 17, the corner posts 144 can be utilized in a manner similar to that described above with reference to FIG. 10. Additionally, an end 104A—e.g., a custom made end—can be used on the back of the drying container 100 to replace, e.g., a roll-up door that may exist on the storage container 50.

FIGS. 18A, 18B, 18C, 18D, 18E, and 18F are a series of drawings that illustrate the conversion of the support legs of a mobile drying container 600 to a skid support system with moveable connections or couplings to allow the mobile drying container 600 to be supported on uneven ground. The mobile drying container 600 is shown with an opening 602 in a front wall (or end wall) leading to the lower volume of the mobile drying container 600 so that a dryer, such as a peanut dryer, may be connected to the mobile drying container 600 to allow hot or warmed air to flow into the lower volume, up through the ventilated floor, and through the crop, such as peanuts, previously loaded into the upper volume of the mobile drying container 600. In other embodiments, the opening 602 may be provided on the opposite back wall or, in some embodiments, on the long side wall. It should be understood that the present invention is not limited to the number or the placement of the opening(s) 602. Wheels are shown to illustrate that the mobile drying container 600 may be easily and conveniently moved.

Figure 18A:
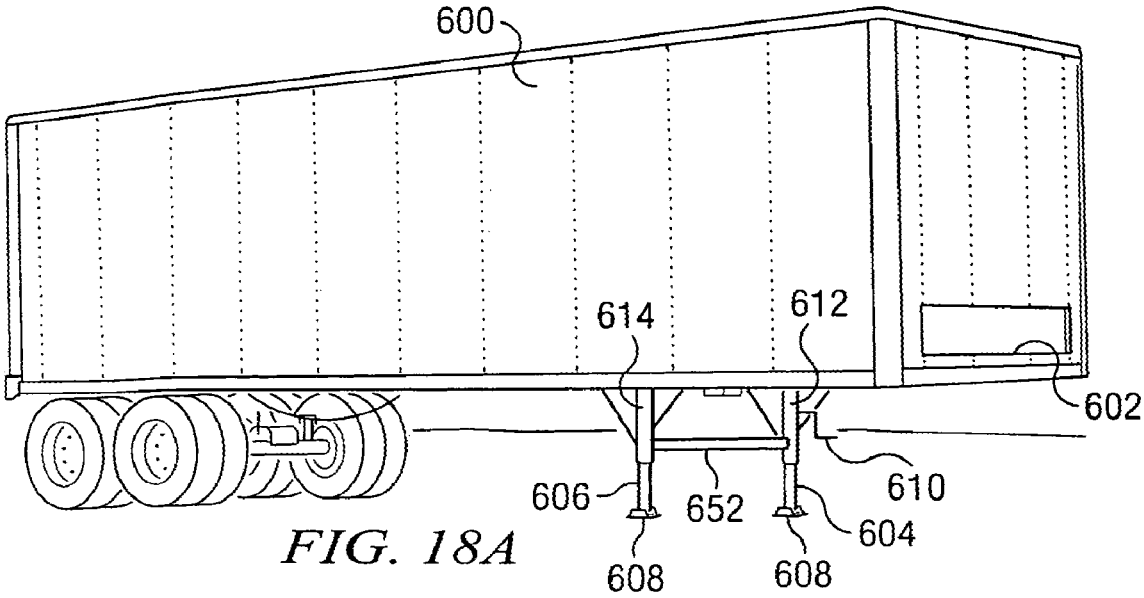
FIGS. 18*a*, 18*b*, 18*c*, 18*d*, 18*e*, and 18*f* are a series of drawings that illustrate the conversion of the support legs to a skid support with moveable connections.
Figure 18B:
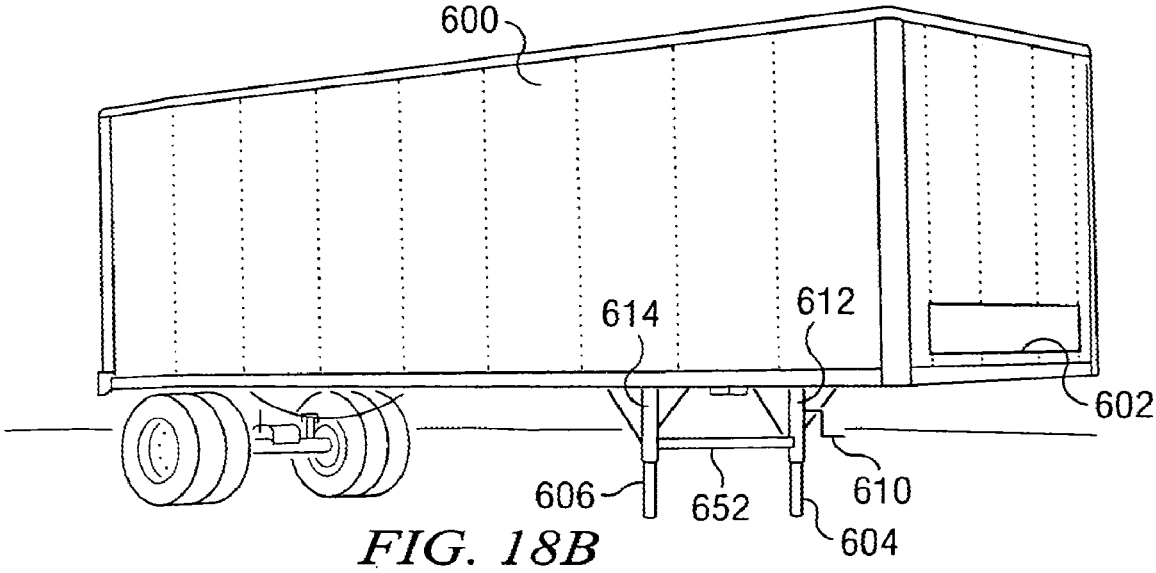
Figure 18C:
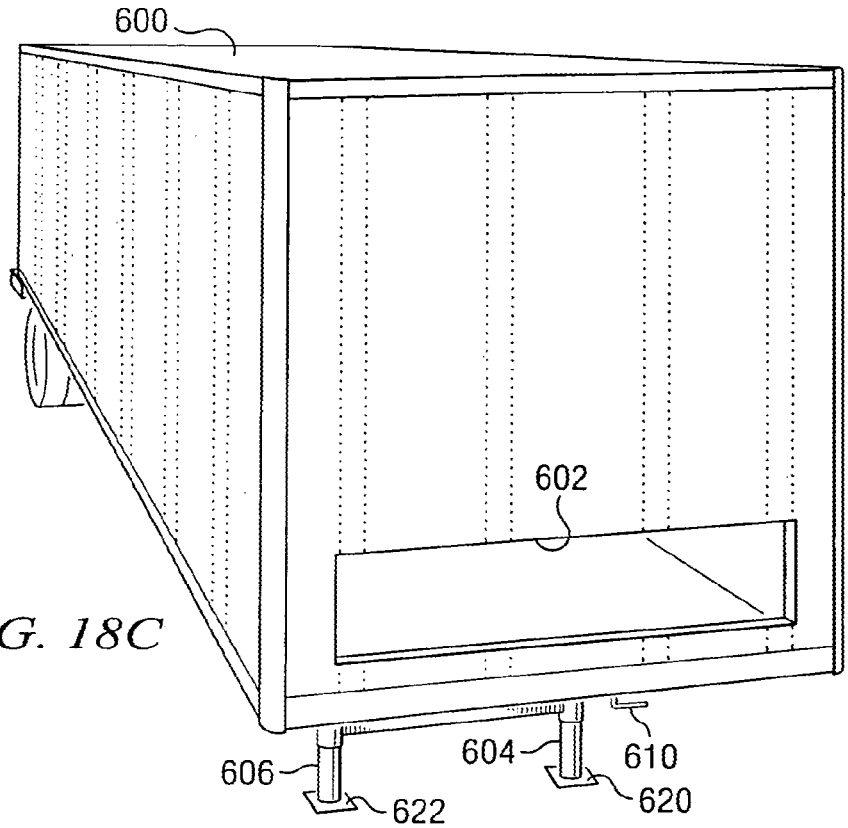
Figure 18D:
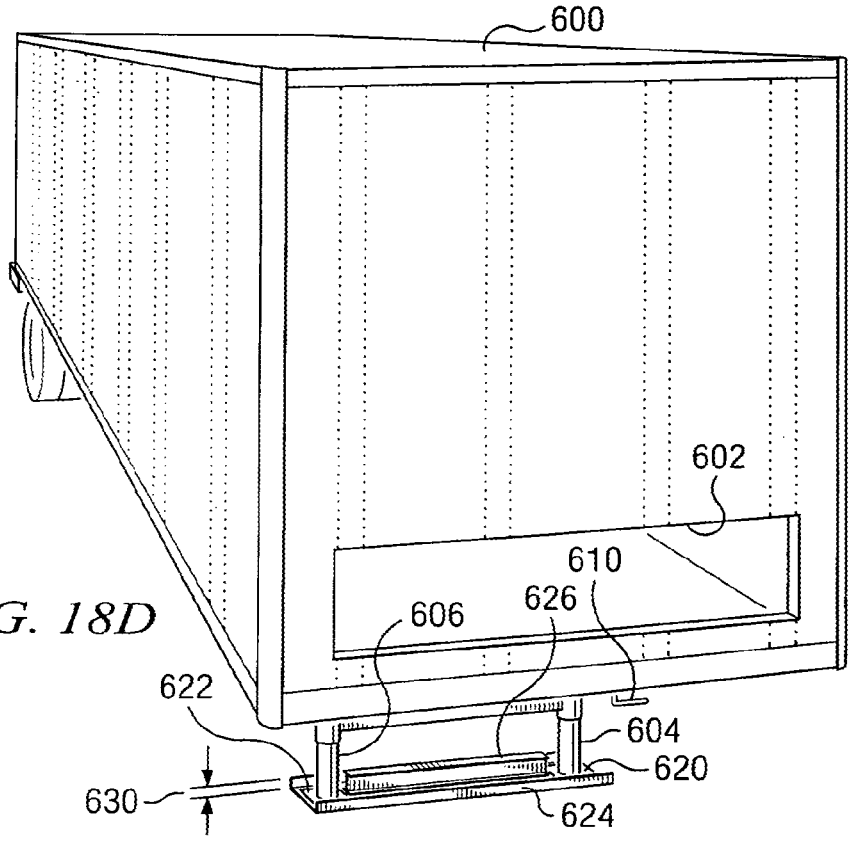
Figure 18E:
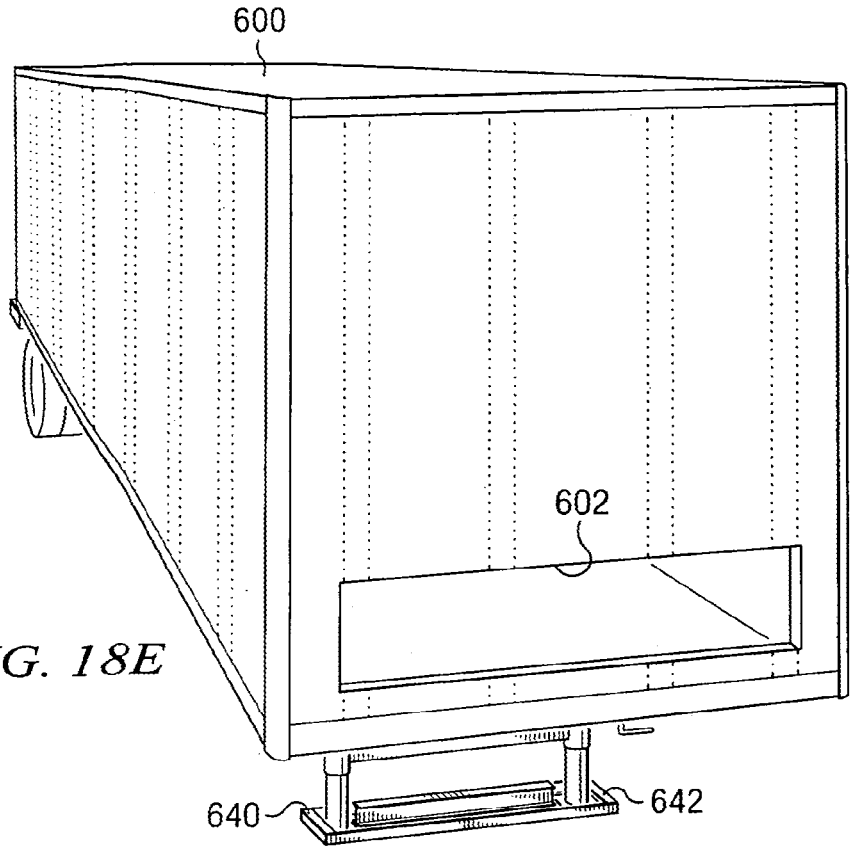
Figure 18F:
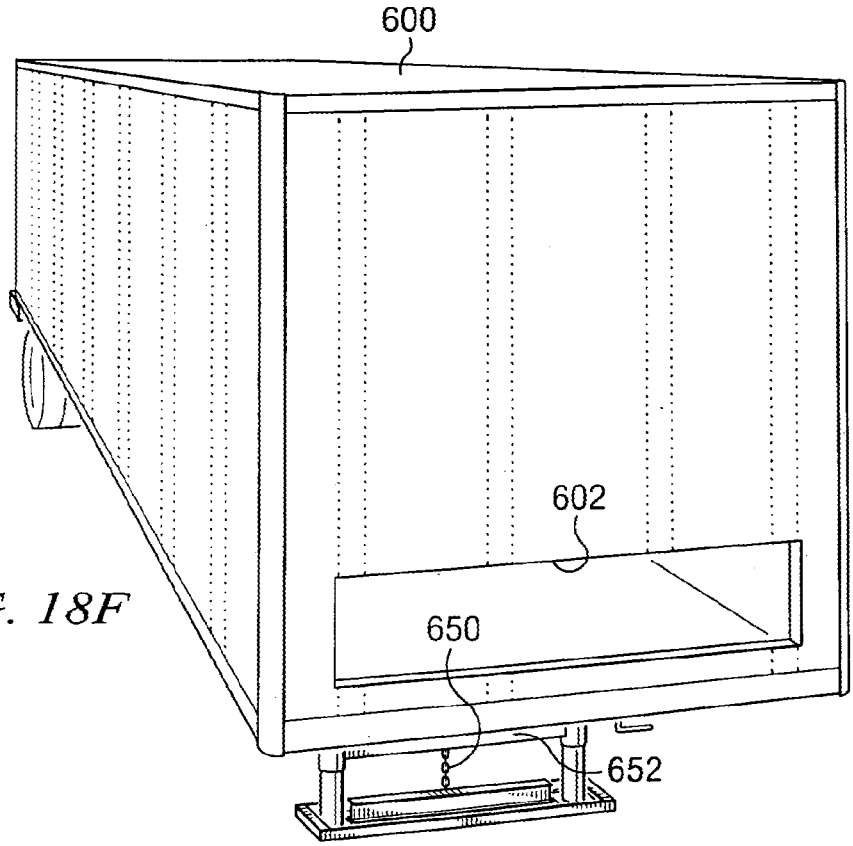
Figure 19:
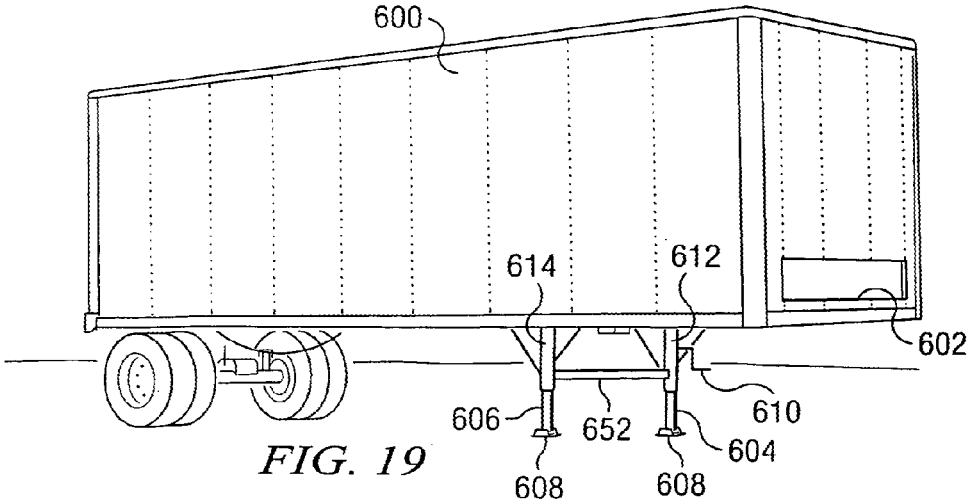
FIGS. 19,20, 21 and 22 illustrate an opening, such as a plenum opening, at a front wall leading to a lower volume of the mobile drying container, and the installation of a front opening cover.

The moveable connections, described more fully in connection with FIGS. 18E and 18F, reduce the likelihood that the skid support system will bind when the skid support system is being raised and lowered.

A traditional support leg system is shown in FIG. 18A. This support leg system includes a first extendable support leg and second extendable support leg connected through a horizontal member 652. The first extendable leg includes an upper portion 614, a retractable end 606, and a footing 608. The second extendable leg includes an upper portion 612, a retractable end 604, and a footing 608. A crank 610 is shown for raising and lowering (or extending and retracting) the skid support system.

In FIG. 18B, the footings 608 are shown removed from the retractable end of each extendable leg. In FIG. 18C, a first plate 622 is shown coupled or attached to the end of the retractable end 606, and a second plate 620 is shown attached to the end of the retractable end 604. This may be achieved, in certain embodiments, by welding the plates to the end of the retractable ends of the extendable legs.

FIG. 18D illustrates a tray or skid 624 shown positioned under the first plate 622 and the second plate 620, and extending between the two extendable and retractable legs. In one embodiment, a rigid member 626 is provided between the two legs and on the skid 624 to provide additional stability or rigidity to prevent the skid 624 from bending or buckling when the mobile drying container is positioned on an uneven surface or ground.

The depth of the skid 624 is illustrated by the distance 630. This distance is greater than the thickness of the first plate 622 and the second plate 620. Because, in one embodiment, the first plate 622 and the second plate 620 are not directly welded or coupled to the skid 624, the difference in the thickness or distance 630 and the thickness of the plates 622 and 620 allow for some movement, as will be discussed more fully below.

FIG. 18E illustrates the installation of an end cap 640 and 642 to both ends of the skid 624. The end caps 640 and 642 prevent the skid from being removed from the first plate 622 and the second plate 620, but allow for a "moveable connection" because the distance 630 is greater than the thickness of the first plate 622 and the second plate 620. This provides the significant advantage of reducing the frequency and tendency for the extendable legs to "freeze" or "bind" up when being raised and lowered using the crank 610. This allows the skid 624 of the mobile drying container 600 to be conveniently raised and lowered, even when positioned on uneven ground while still being able to raise and lower the legs.

FIG. 18F illustrates the mobile drying container 600 with a chain 650 attached between the horizontal member 652 and the skid 624 (or the rigid member 626). This provides additional safety assurances to prevent the skid 624 from falling or breaking loose while the mobile drying container 600 is in transit.

Figure 20:
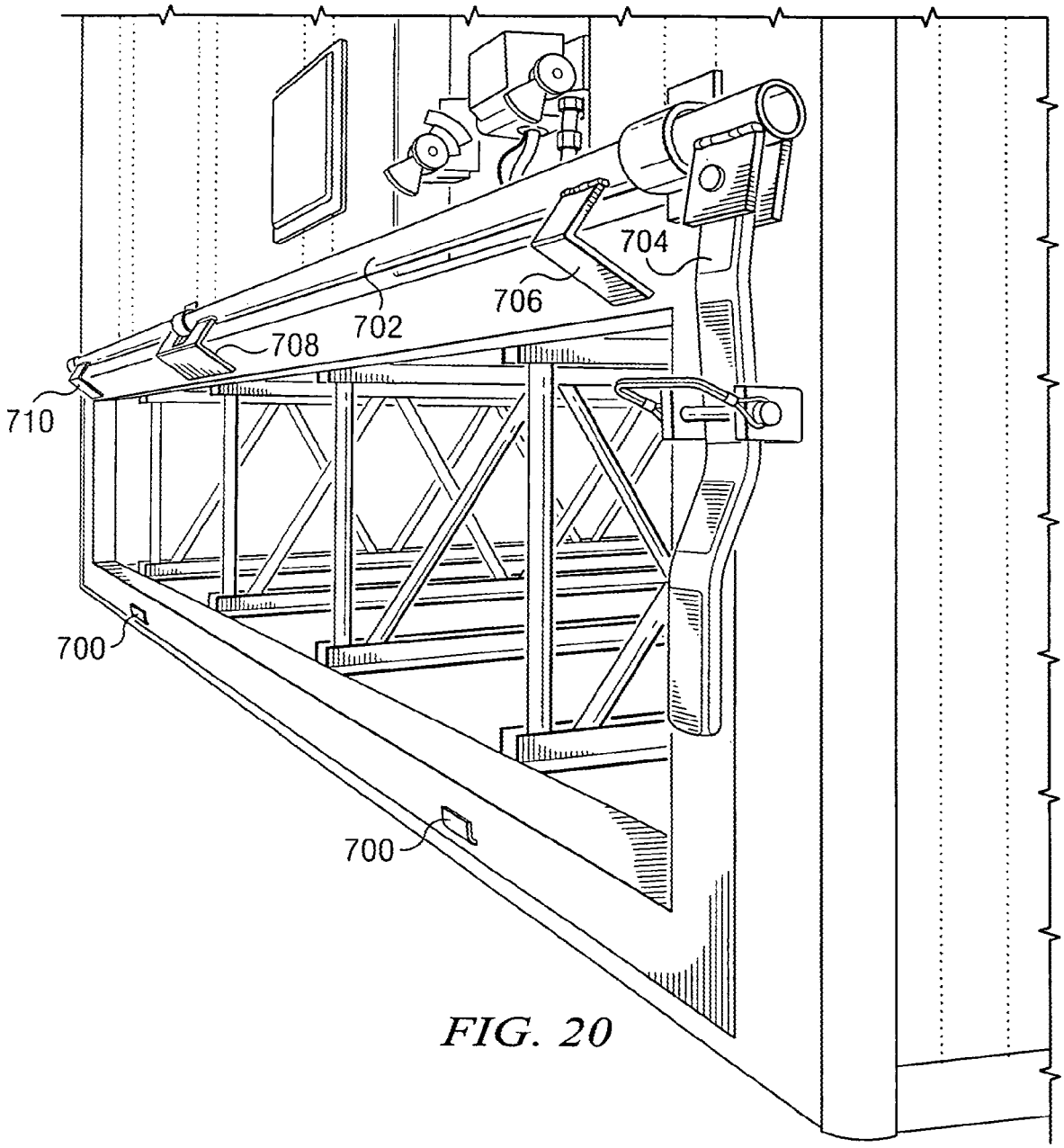

FIGS. 19,20, 21 and 22 illustrate an opening 602, such as a plenum opening, at a front wall leading to a lower volume of the mobile drying container 600, and the installation of a front opening cover. FIG. 20 illustrates a close-up view illustrating one mechanism to hold an opening cover in position as desired when the opening is not being used. A rod 702 may extend above the opening and include tabs that rotate up and down when a lever 704 is moved. The tabs can grip the opening plate or cover.

Figure 21:
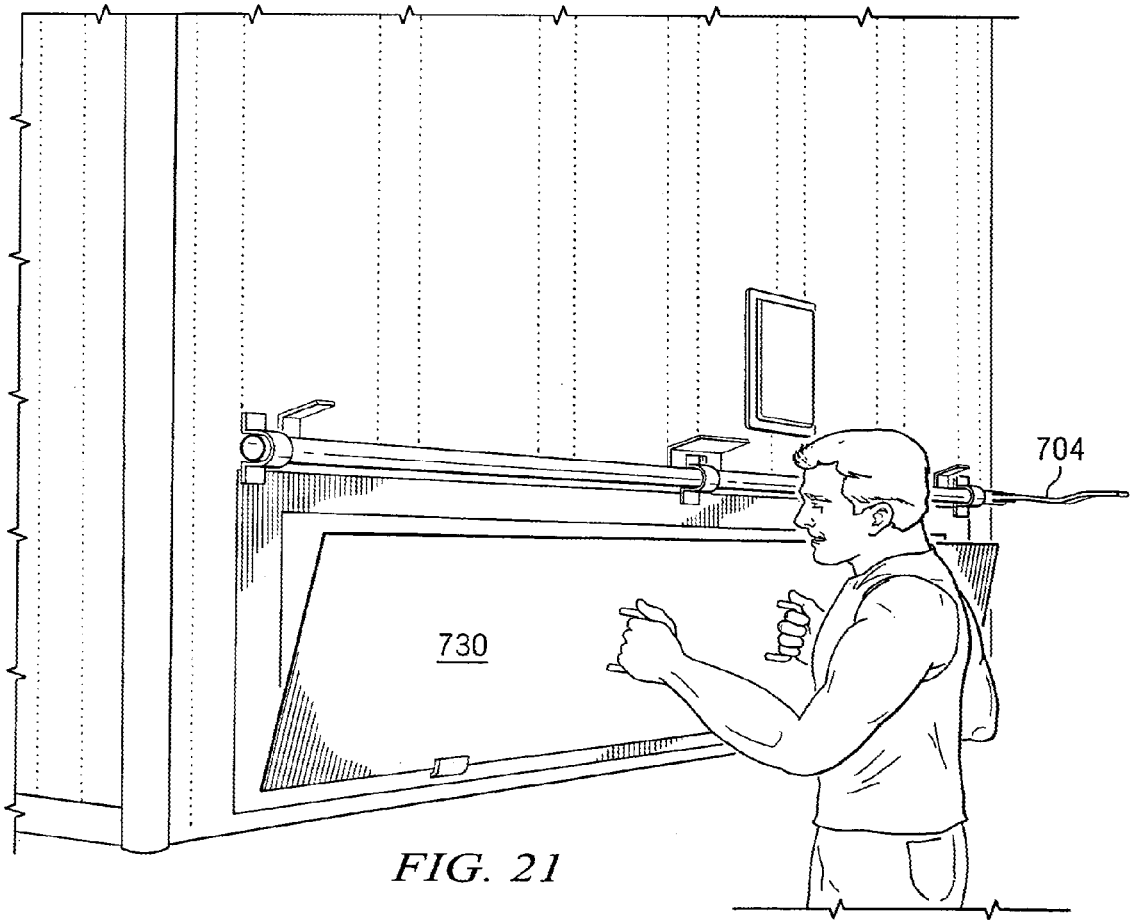
Figure 22:
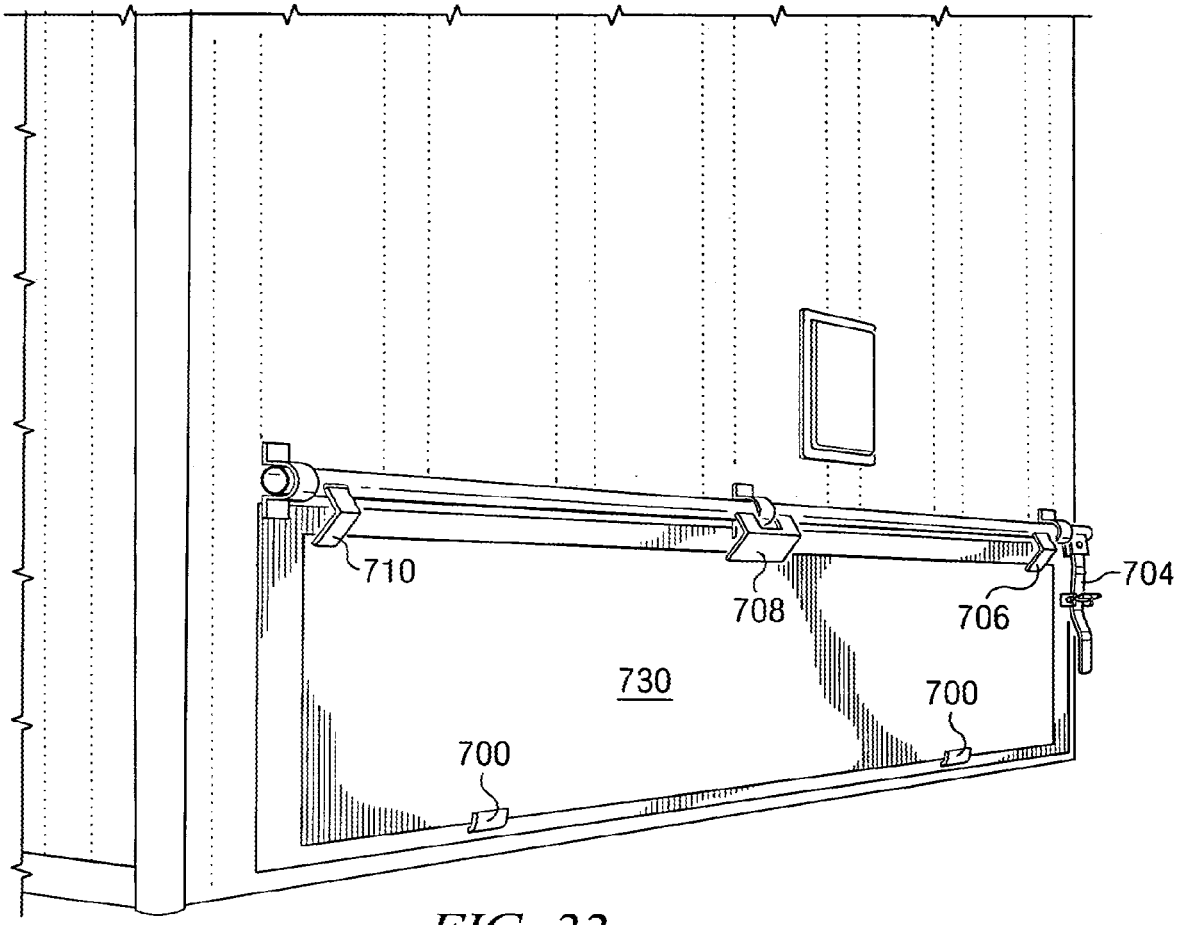

FIGS. 21 and 22 shows this installation of the opening cover 730 with the tabs at the top holding the upper edge of the cover 730 and the slots 700 holding the bottom edge of the opening cover 730 to securely hold the opening cover 730.

Figure 23:
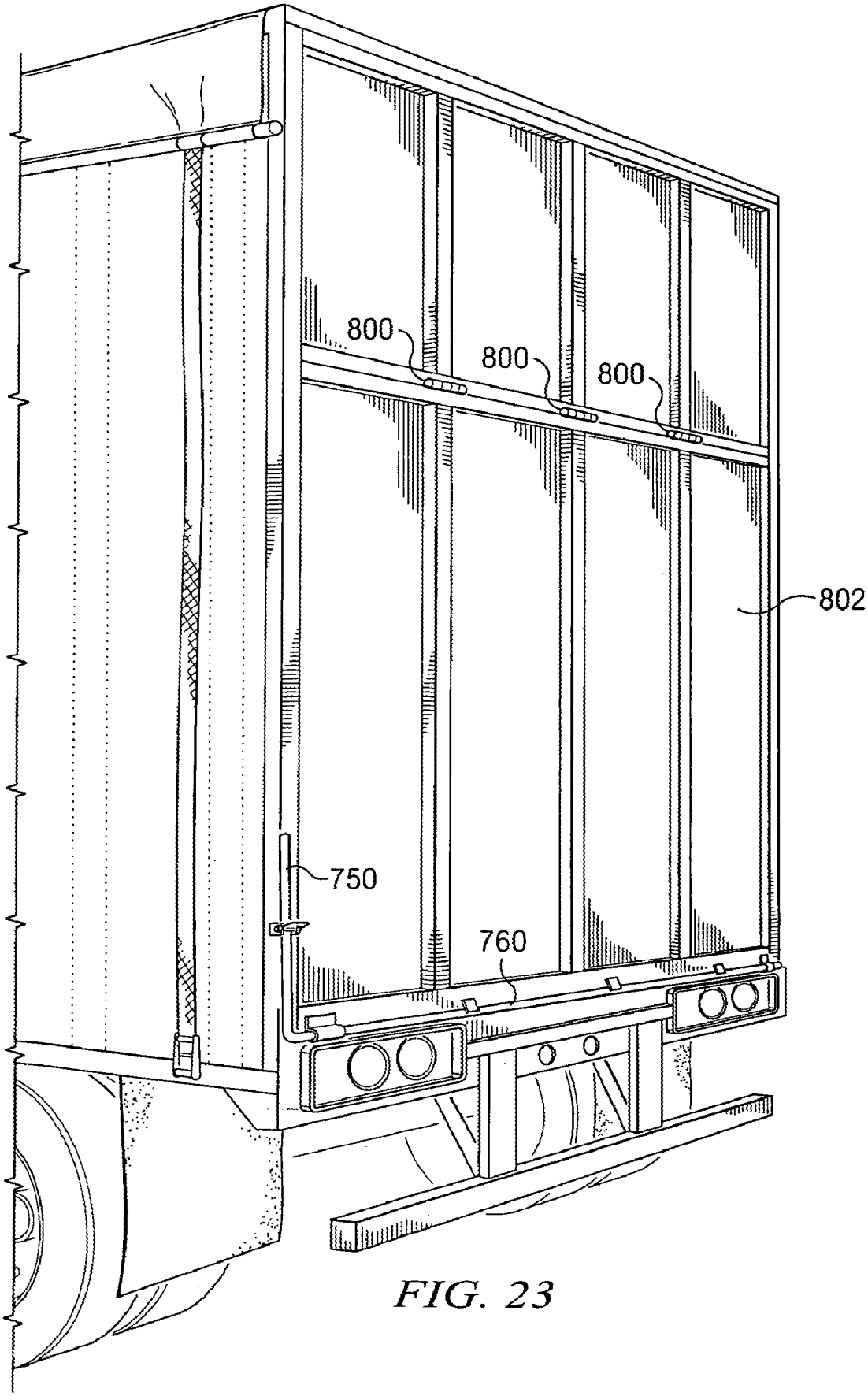
FIG. 23 illustrates a hinged gate of the back wall of a mobile drying container.

FIG. 23 illustrates a hinged gate 802 of the back wall of a mobile drying container. The hinges 800 are shown at the top of the hinged gate 802 so that the crop, such as a load of peanuts, may be safely dumped from the top or upper volume of the mobile drying container. A lever 750 is shown connected to a member or rod 760 such that the lever 750 may be pulled, while standing at the side of the container to rotate the rod 760 allowing for one or more tabs on the rod 760 to be moved away from the bottom edge of the hinged gate 802. This allow for the crop to push open the bottom edge of the hinged gate 802 so that the crop can be dumped.

Figure 24:
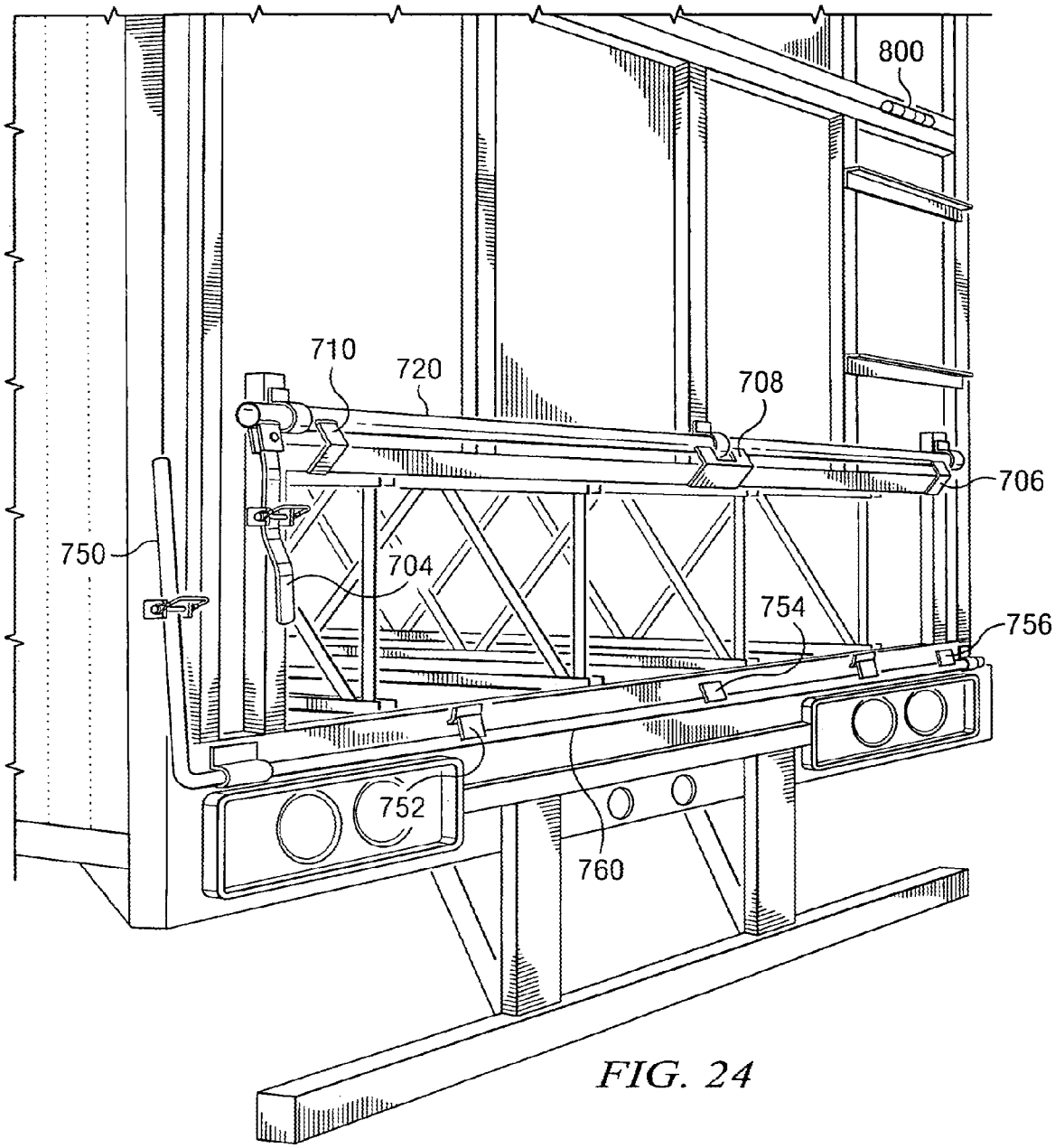
FIGS. 24, 25, and 26 illustrate an opening at a back wall leading to a lower volume within the mobile drying container, and included as part of the hinged gate, such as that illustrated in FIG. 23.
Figure 25:
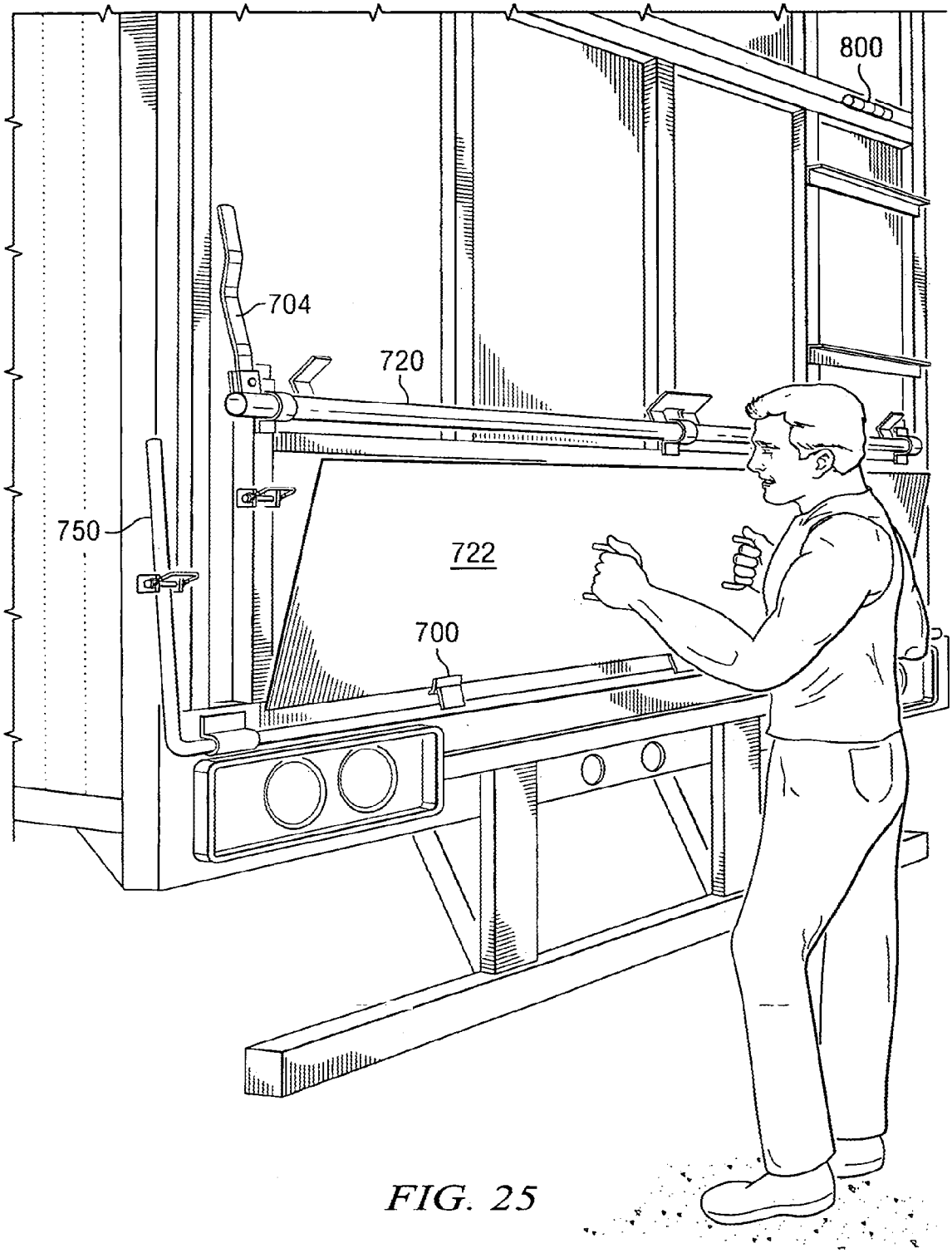
Figure 26:
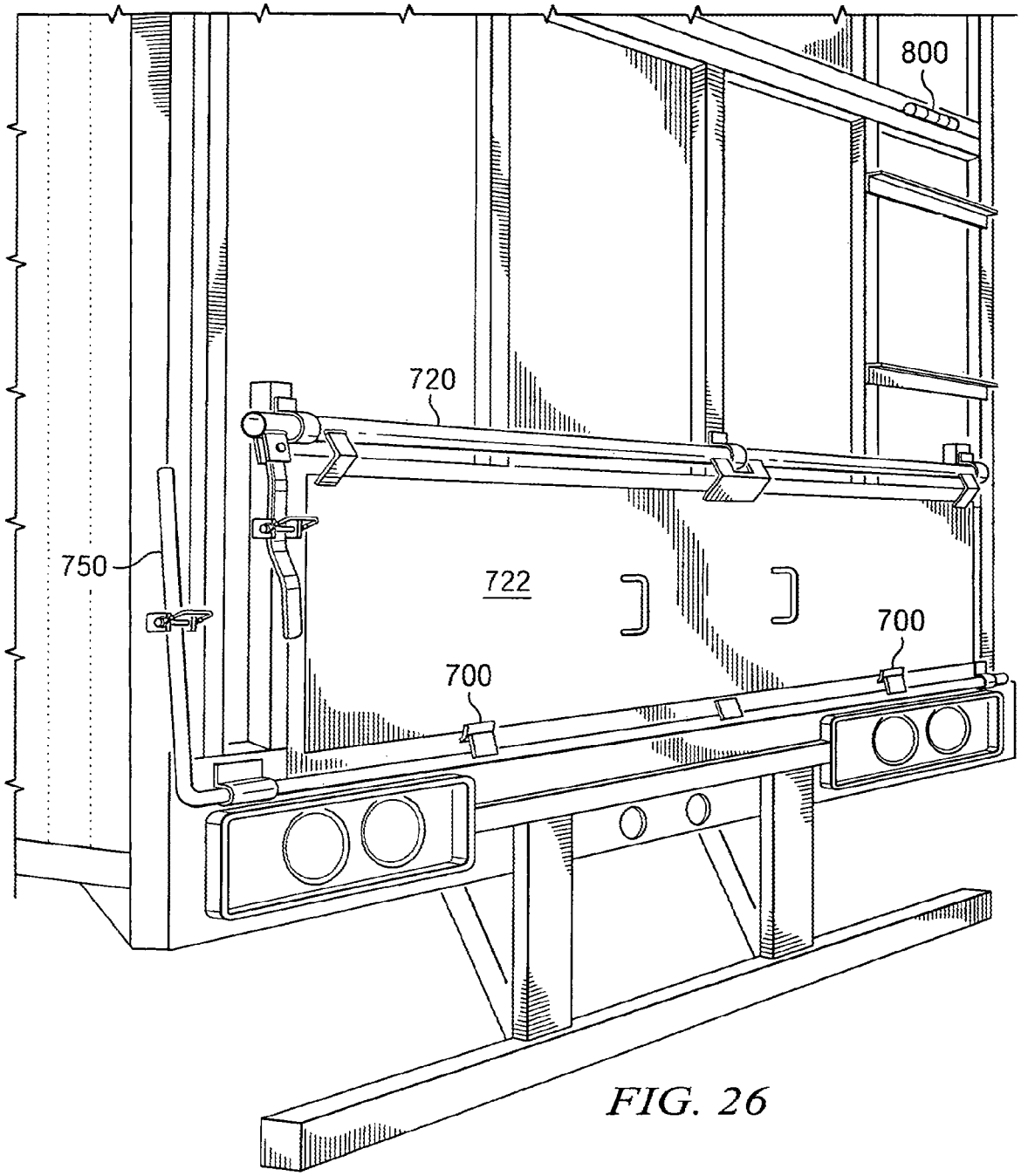

FIGS. 24, 25, and 26 illustrate an opening at a back wall leading to a lower volume within the mobile drying container, and included as part of the hinged gate, such as that illustrated in FIG. 23. A bar 720 is shown with various tabs 706, 708 and 710 shown with a lever 704 to operate as described above in connection with FIGS. 20-22 to hold and secure an opening cover.

A lever 750 is shown coupled to a rod 760 with various tabs 752, 754 and 756 to secure the bottom edge of the hinged gate 802. A hinge 800 is shown in FIG. 26. When the rod 760 is turned the tabs release the bottom edge of the hinged gate so that the upper volume of crop, such as peanuts may be dumped.

Although the preferred embodiment has been described, it should be understood that various changes, substitutions, and alterations can be made herein without departing from the scope of the present invention, even if all, one, or some of the advantages identified above are not present. These are only a few of the examples of other arrangements or configurations of the system that is contemplated and covered by the present invention.

The various components, configurations, and materials described and illustrated in the preferred embodiment as discrete or separate may be combined or integrated with other components, configurations, and materials of other embodiments without departing from the scope of the present invention. Other examples of changes, substitutions, and alterations are readily ascertainable by one skilled in the art and could be made without departing from the spirit and scope of the present invention.

What is claimed is:

1. A mobile drying container for drying a crop, the mobile drying container comprising:

a first side wall;

a second side wall;

a front wall;

a back wall;

an interior bottom;

a ventilated floor supported above the interior bottom by a plurality of support members;

an upper volume defined by the first side wall, the second side wall, the front wall, the back wall, and the ventilated floor, the upper volume operable to contain the crop to be dried;

a lower volume defined by the volume below the ventilated floor structure and above the interior bottom, the lower volume operable to receive a flow of air to assist with the drying of the crop;

a plurality of wheels positioned below the interior bottom;

a first support leg positioned below the lower volume, the first support leg having a retractable end operable to be raised and lowered;

a second support leg positioned below the lower volume, the second support leg having a retractable end operable to be raised and lowered; and a free-floating skid support movably coupled to at least one of the first support leg or the second support leg, and connecting the retractable ends of the first support leg and the second support leg, wherein the skid support may be raised and lowered through the retractable ends of the first support leg and the second support leg, and provides support between the mobile drying container and a surface.

2. The mobile drying container of claim 1, wherein the skid support includes a first end, a second end, and a rigid member positioned between the first end and the second end of the skid support to provide additional rigidity to the skid support.

3. The mobile drying container of claim 1, further comprising:

a first plate coupled to the retractable end of the first support leg; and a second plate coupled to the retractable end of the second support leg, wherein the skid support includes a first end movably coupled to the first plate, and a second end movably coupled to the second plate, wherein the skid support may be raised and lowered through the retractable ends of the first support leg and the second support leg, and provides support between the mobile drying container and a surface on an uneven surface using the movable couplings.

4. The mobile drying container of claim 3, wherein the skid support includes a rigid member positioned between the first end and the second end of the skid support to provide rigidity to the skid support.

* * * * *